US005576157A

United States Patent [19]

Eikenberry et al.

[11] Patent Number: 5,576,157

[45] Date of Patent: Nov. 19, 1996

[54] PHOTOGRAPHIC ELEMENT CONTAINING EMULSION WITH PARTICULAR BLUE SENSITIVITY

[75] Inventors: Jon N. Eikenberry, Rochester; John D. Buhr, Webster; Jeffrey L. Hall, Rochester, all of N.Y.

[73] Assignee: Eastman Kodak Company, Rochester, N.Y.

[21] Appl. No.: 473,685

[22] Filed: Jun. 7, 1995

Related U.S. Application Data

[63] Continuation-in-part of Ser. No. 228,234, Apr. 15, 1994, abandoned.

[51] Int. Cl.[6] ..... G03C 1/46

[52] U.S. Cl. ..... 430/503; 430/567; 430/570; 430/556; 430/557; 430/359

[58] Field of Search ..... 430/503, 502, 430/567, 570, 556, 557, 359

[56] References Cited

U.S. PATENT DOCUMENTS

| | | | |
|---|---|---|---|
| H1243 | 10/1993 | Shimba et al. | 430/508 |
| 3,652,284 | 3/1972 | Oliver | 96/84 |
| 3,672,898 | 6/1972 | Schwan et al. | 96/74 |
| 3,746,539 | 7/1973 | Ohmatsu et al. | 96/68 |
| 3,847,613 | 11/1974 | Sakazume et al. | 96/74 |
| 4,320,193 | 3/1982 | Robillard | 430/503 |
| 4,359,280 | 11/1982 | Krause | 355/37 |
| 4,469,785 | 9/1984 | Kanaka et al. | 430/572 |
| 4,582,786 | 4/1986 | Ikeda et al. | 430/577 |
| 4,611,918 | 9/1986 | Nishida et al. | 356/404 |
| 4,663,271 | 5/1987 | Nozawa et al. | 430/503 |
| 4,680,253 | 7/1987 | Shibahara et al. | 430/504 |
| 4,952,491 | 8/1990 | Nishikawa et al. | 430/570 |
| 5,037,728 | 8/1991 | Shiba et al. | 430/505 |
| 5,053,324 | 10/1991 | Sasaki | 430/504 |
| 5,084,374 | 1/1992 | Waki et al. | 430/504 |
| 5,085,979 | 2/1992 | Yamagami et al. | 430/505 |
| 5,093,222 | 3/1992 | Katoh | 430/264 |
| 5,166,042 | 11/1992 | Nozawa | 430/504 |
| 5,180,657 | 1/1993 | Fukazawa et al. | 430/503 |
| 5,183,730 | 2/1993 | Yagi | 430/503 |
| 5,185,237 | 2/1993 | Kawai | 430/505 |
| 5,190,850 | 3/1993 | Sakai et al. | 430/503 |
| 5,200,308 | 4/1993 | Ohtani et al. | 430/508 |
| 5,212,056 | 5/1993 | Beltramini | 430/572 |
| 5,250,403 | 10/1993 | Antoniades et al. | 430/505 |
| 5,252,444 | 10/1993 | Yamada et al. | 430/503 |
| 5,258,273 | 11/1993 | Ezaki et al. | 430/509 |
| 5,272,048 | 12/1993 | Kim et al. | 430/569 |

FOREIGN PATENT DOCUMENTS

| | | |
|---|---|---|
| 498238 | 8/1992 | European Pat. Off. . |
| 569126 | 11/1993 | European Pat. Off. . |
| 62-178965 | of 0000 | Japan . |
| 62-160449 | of 0000 | Japan . |
| 2167539 | of 0000 | Japan . |
| 2302755 | 5/1989 | Japan . |
| 438049 | 1/1990 | Japan . |
| 404000442 | 1/1992 | Japan . |
| 404056952 | 2/1992 | Japan . |
| 404240845 | 8/1992 | Japan . |

OTHER PUBLICATIONS

*Journal of Applied Photographic Engineering*, vol. 5, No. 2, Spring, 1979; E. Groll, D. Hill, W. Severin, Modern Exposure Determination for Customizing Photofinishing Printer Response, pp. 93–104.

*Primary Examiner*—Geraldine Letscher
*Attorney, Agent, or Firm*—Arthur E. Kluegel

[57] ABSTRACT

A color photographic negative element which has a transparent base and a blue sensitive silver halide emulsion layer. The foregoing blue sensitive layer meets each of the following spectral sensitivity requirements:

$$S_{max\ (426-444\ nm)} \geqq 65\% S_{max(400-500\ nm)}$$

$$IS_{(425-450)} \geqq 25\% (IS_{(400-500)})$$

in which $S_{max(426-444\ nm)}$ is the maximum sensitivity between 426 to 444 nm, $S_{max(400-500\ nm)}$ is the maximum sensitivity between 400–500 nm, $IS_{(425-450)}$ is the integrated spectral sensitivity of the blue sensitive layer from 425 to 450 nm, and $IS_{(400-500)}$ is the integrated spectral sensitivity of the blue sensitive layer in the region 400–500 nm. A method for printing a negative obtained from exposing and processing an element of the foregoing type, on automatic printers which automatically compensate for color bias, is also provided.

17 Claims, 3 Drawing Sheets

PHOTOGRAPHIC ELEMENT CONTAINING EMULSION WITH PARTICULAR BLUE SENSITIVITY

CROSS-REFERENCE TO RELATED APPLICATIONS

This application is a continuation-in-part of U.S. application Ser. No. 08/228,234 filed Apr. 15, 1994, now abandoned, which is incorporated herein by reference.

FIELD OF THE INVENTION

This invention relates to a photographic element which has a blue sensitive layer with a defined blue spectral sensitivity profile, and a method of producing prints from such an element.

BACKGROUND OF THE INVENTION

Typical color photographic negatives have three records which are sensitive to respective areas of the visible light spectrum, namely red, green and blue. Each record is usually in the form of one or more layers each containing a light sensitive silver halide emulsion. These records also contain couplers which imagewise produce cyan, magenta and yellow dyes, respectively. In a color negative film, the records are usually arranged on a support in the order of red, green and blue sensitive records (that is, the blue sensitive record is furthest from the support).

Conventional silver halide emulsions usually have grains which are primarily cubic, octahedral, cubo-octahedral or polymorphic in shape. Such grains typically have an inherent sensitivity to visible light in the region of about 400–430 nm. Therefore, sensitizing dyes are used on the emulsions to sensitize them to the required red and green region of the spectrum, with a blue sensitizing dye typically being used to sensitize the blue sensitive emulsion to the 450–500 nm region.

Tabular grain emulsions are known for use in the blue sensitive layer of a color negative film. Tabular grains, when present in the blue sensitive layer, result in improved transmission of incident light to the underlying green and red sensitive layers. Such grains are also sensitized in the 450–500 nm region for blue sensitive emulsions. While such grains have little inherent sensitivity in the 400–430 nm range, such emulsions are typically sensitized in the 450–500 nm region since there are more photons in that region than 400–450 nm and thus sensitivity of the blue record is maximized. Since there is a finite amount of grain surface area and hence a limited amount of sensitizing dye that can be adsorbed to silver halide grains, adding additional sensitizing dye to sensitize outside the 450–500 nm region will typically result in less overall sensitivity of the emulsion.

Following imagewise exposure and processing, the image of the negative is usually printed onto a receiver (typically having a paper base although potentially a transparent base might also be used) to yield a positive image. The overall color quality of the prints depends on the relative amounts of cyan, magenta and yellow densities in the negative. Color negative films are designed so that, for a specific taking illuminant (usually daylight), a specified cyan, magenta, and yellow density relationship is effected when a gray uniform target is photographed. However, not all exposed and processed negatives will have a total dye density which in fact integrates over the entire negative to equal gray. There are several causes for this, including chemical processing variations, latent image and film keeping variability, scene spectral illumination variations, as well as scenes composed of objects which do not integrate to gray such as a white cat sleeping on a red car hood.

For example, when pictures are taken under some types of fluorescent lights, prints are usually produced with a green bias which is objectionable. This green bias, or whatever color bias as caused by scene illuminant or other factors described above, can be partially corrected by custom printing the particular negative with the appropriate color filters (that is, by adjusting the amount of red, green or blue light exposure through the negative). In custom printing, such adjustments are made by the person operating the printer, for each negative according to the operator's experience and by trial and error. Custom printing, however, is a time consuming way of producing more acceptable photographic prints.

Automatic printers have been developed to attain rapid and more economical printing from color negatives. Well designed printers have a set of red, green, and blue sensitivities in one large or any number of smaller sensors which are used by the printer algorithum to assess the red, green, and blue densities (that is, the red, green and blue densities integrated by the printer algorithum over the entire negative) in effectively the same way as does a photographic paper which is used in the printer. These printers are set up so that the red, green, and blue densities of a standard negative when exposed with a gray target under the film design illuminant, typically daylight, are recognized as being a neutral film exposure. Thus, for such a negative, the integrated red, green and blue density relative to a gray center, referenced as D', has a value of D'=0. In any printer this leads to adjustment of the appropriate red, green or blue light exposures of the negative to the print (for example, by controlling the duration or intensity of those colors through the use of direct control of the light source(s) and/or filters), to yield a perfect gray print balance.

However, when such an automatic printer encounters an exposed negative for which D' is not equal to zero, the printer algorithm is designed to alter (or "correct") the red, green and/or blue light exposure, in a manner which depends on the value of D'. The degree to which this correction is applied varies depending on the particular printer algorithm used. Due to the diverse causes of color bias, well designed printers do not apply 100% correction. Simple algorithms apply some smaller correction, often 50% to minimize the chances of removing all the color bias in the film which can significantly alter the appearance of captured scenes which do not integrate to gray. More complex algorithms alter the amount of correction depending on the color bias direction-(hue) to make a more intelligent assessment as to how much of the bias to correct based on known hue-dependent bias causes. The operation of such algorithms is described in "Modern Exposure Determination for Customizing Photofinishing Printer Response" by E. Goll, D. Hill, and W. Severin, published in *Journal of Applied Photographic. Engineering.*, Vol 5, Number 2, pages 93–104, 1979.

By the foregoing process the automatic printer attempts to remove some or all of the color bias (that is, the degree to which D' differs from 0, sometimes referenced in this application as "saturation" of a negative) recognized by the printer in the film frame. The goal of the printer is to reduce in the print as much as possible, all the color bias in the negative to be printed except that caused by the objects in the scene itself and occasionally some of the bias caused by the scene illuminant (as in pictures taken at sunset) so that the printed reproduction appears to the viewer as the original scene is remembered.

It would be desirable to provide a color negative which can be printed in automatic printers of the above described type and produce prints which have low objectionable color bias even though the negative may have been exposed under different lighting conditions, and particularly under fluorescent lighting. It would further be desirable if such a negative could use a tabular grain emulsion as the silver halide emulsion of the blue sensitive layer.

SUMMARY OF THE INVENTION

The present invention realizes that the key to designing a film which will allow the printer to produce the minimum amount of incorrect color correction in the resulting prints due to scene illuminant variation is to minimize the printer saturation parameter, D'. Regardless of the correction factor any particular automatic printer algorithm may apply, lower printer saturation parameters will always lead to lower residual print color bias. The printer saturation parameter can be minimized for the same negative imagewise exposed under different lighting conditions, by maintaining similar red, green, blue density relationships under all illuminants of interest. In the case of a color negative film which may be exposed under fluorescent lighting or daylight, this means the film should have a low printer saturation parameter under those conditions. Since the amount of dye produced by any coupler in a color record will depend on the sensitization of the layer in which it is located, this implies controlling the sensitization of each layer so that it will be sufficiently similar under daylight or fluorescent lighting.

The present invention also realizes that most fluorescent lights have a narrow strong emission at 435nm and relatively low emission between 450–500 nm. In order to obtain prints in automatic printers which do not have high color bias, regardless of whether they are exposed under daylight or fluorescent light, the blue sensitive record should contain an emulsion which has a high sensitivity in the region of 435 nm.

Accordingly, the present invention provides a color photographic element (preferably a "color negative element" as defined herein) comprising a base (sometimes referenced as a "support") and a blue sensitive silver halide emulsion layer which satisfies each of the following spectral sensitivity requirements:

$$S_{max\ (426-444\ nm)} \geqq 65\% S_{max\ (400-500\ nm)}$$

$$IS_{(425-450)} \geqq 25\% (IS_{(400-500)})$$

in which $S_{max(426-444\ nm)}$ is the maximum sensitivity between 426 to 444 nm, $S_{max(400-500\ nm)}$ is the maximum sensitivity between 400–500 nm, IS(425–450) is the integrated spectral sensitivity of the blue sensitive layer from 425 to 450 nm, and $IS_{(400-500)}$ is the integrated spectral sensitivity of the blue sensitive layer in the region 400–500 nm The present invention also provides a process of printing a positive from a subject color negative on the foregoing type of photographic element (particularly such negatives that have been exposed under fluorescent lighting). The method comprises printing the negative in a printer which measures color densities and evaluates the difference in color densities of the subject negative relative to a standard negative, and automatically adjusts the amount of red, green or blue light exposure (or any two, or all three) for the subject negative based on the difference in color densities so that the print produced from the subject negative will have a color balance closer to that of an optimum color balance of a print produced from the standard negative. By "automatically adjusts" is meant that the printer can carry out the necessary adjustment without operator manual adjustment, according to a preset suitable algorithm (which algorithm itself may be varied by a printer operator).

Film neutral gamma (that is, the slope of the DlogE curve) affects film densities. Lowering film gamma will therefore decrease the printer saturation parameters. However, for a given film neutral gamma, the present invention can provide a lower printer saturation parameter and lower the color bias of a print printed from a negative in an automatic printer.

EMBODIMENTS OF THE INVENTION

Figure 1:
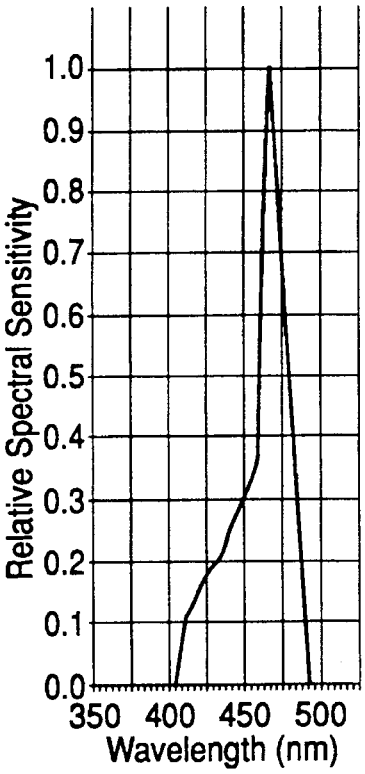
FIGS. 1 to 6 show the sensitivity profile of the blue sensitive layers of the films Examples 1–6, respectively.
Figure 2:
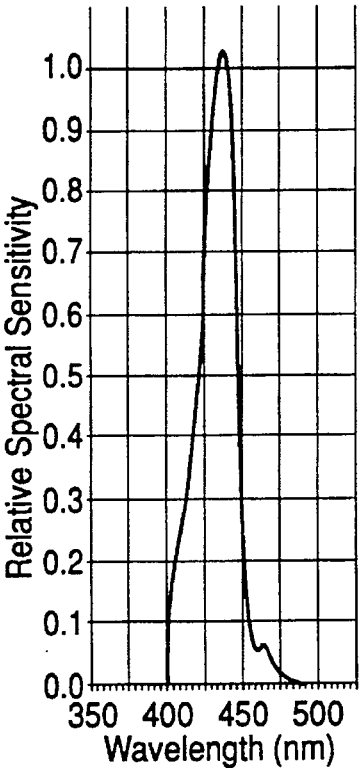
Figure 3:
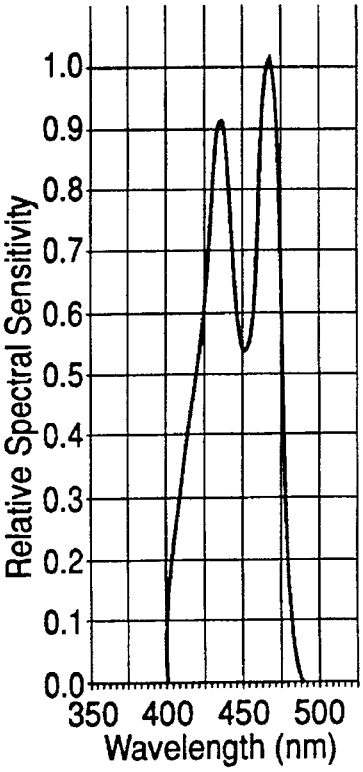
Figure 4:
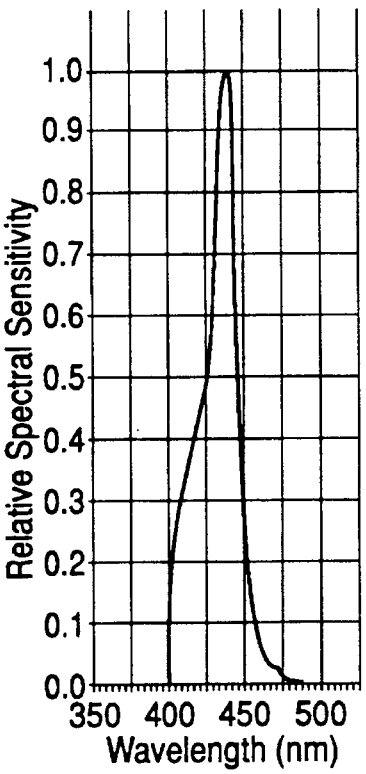
Figure 5:
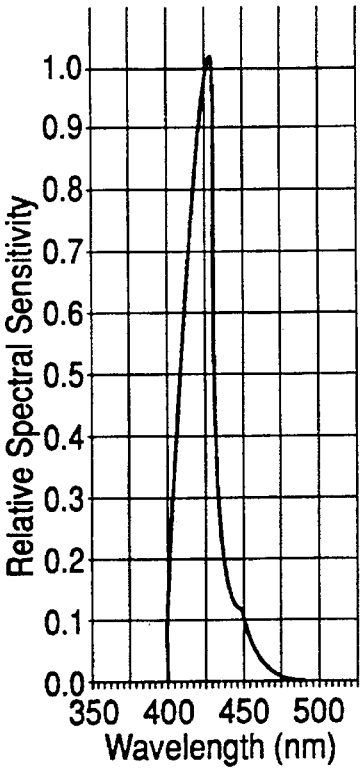
Figure 6:
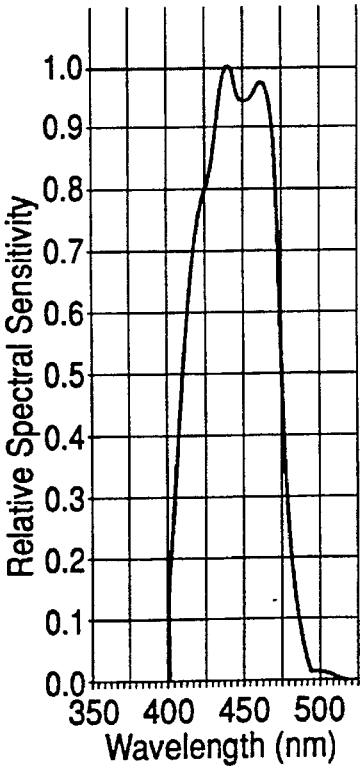

It will be appreciated that in the above method, the "standard negative" could be almost any negative which reproduces a gray card well when exposed under daylight. The standard negative referred to herein can be a negative the same as the subject negative or the same except for the spectral sensitization of the blue sensitive layer. Thus, the standard negative for blue tabular grain films will usually have an all tabular grain silver halide emulsion layer or layers for the blue sensitive record, and each of which has been sensitized with a sensitizing dye to the 450–500 nm region only. However, in practice typical standard negatives are derived from a population of negatives of a kind which the printer is likely to process (for example, consumer pictures), the standard negative in such a case being that one which has statistically averaged red, green and blue densities based on such a population. An "optimum color balanced print" produced from the standard negative is a print which is obtained from a standard negative when the negative is given the red, green and blue light exposures required such that the print has the same color balance as the gray card (in the first case) or the statistically averaged red, green and blue densities of the population (in the second case).

A color negative element as described in the present application, means an element which is associated with an indication for processing by a color negative process rather than an indication to process by some other process (such as a color reversal process). Reference to an element being "associated" with an indication for processing by a color negative process, most typically means the element, its container, or packaging (which includes printed inserts provided with the element), will have an indication on it that the element should be processed by a color negative process. The indication may, for example, be simply a printed statement stating that the element is a "negative film" or that it should be processed by a color negative process, or simply a reference to a known color negative process such as "Process C-41". The indication may be a code (such as a bar code) which, when read, would indicate that the element is to be processed by a color negative process.

A color negative element of the present application can be used as a film in what are often referred to as single use cameras (or "film with lens" units). These cameras are sold with film preloaded in them and the entire camera is returned to a processor with the exposed film remaining inside the camera. The camera or its packaging is associated with an indication (usually by means of printed instructions on the camera or its packaging) that the entire camera is to be returned for processing and/or that the camera should not be opened by the user. The film of such cameras is associated with an indication to process by a color negative process in that the camera or its packaging has a printed indication that the camera will is used to obtain "prints" or "color prints" or similar language. Such cameras may have glass or plastic lenses through which the photographic element is exposed.

A color negative process when applied to a color negative element, is a process which produces a dye image which is a negative image of the image to which the element was exposed. Such a process typically involves applying a color developer to the element without applying any non-chromogenic developer (a non-chromogenic developer being one which develops exposed silver but does not form a colored dye in the element) and without fogging silver halide in the element. The color developer reduces silver halide grains having a latent image to silver. The oxidized developer then reacts (typically by coupling) with a color forming compound (such as a color coupler) to form a dye. The dye image formed is a negative of the image to which the element was exposed since more dye is formed in locations where the element received more light (i.e. the developed element will have a lower light transmittance at locations of the element where the most light was received during exposure).

Photographic elements intended for use as color negatives typically contain an inert preformed dye or preformed colorant (which are referenced collectively herein simply as "preformed dye"), or a masking coupler. By a preformed dye or colorant is meant a colored compound which is present in the unexposed and unprocessed element. By "inert" in relation to a preformed dye, is meant that the compound is inert to a color negative or color reversal developing process such that it is still present in the element after processing. In particular, this means that less than 50% (and preferably less than 90%) of the compound, by weight, is decolorized or removed from the photographic element as a result of processing in accordance with the well known standard Process C41 color negative development process, or if the element was processed with the well known standard Process E-6 color reversal development process, as both described in *British Journal of Photography Annual* 1988, pages 194–198. Inert preformed dyes are used in an element intended for color negative processing to balance dye printing densities, but are not used in elements intended for direct viewing (e.g. reversal elements).

Masking couplers are colored couplers (i.e. they are colored in the unexposed and unprocessed element) which are used to correct for unwanted absorption of image dyes formed from exposure and processing of the element. Masking couplers are not used in reversal elements since they leave a color in unexposed areas of the element (this being impermissible in a reversal element which is viewed directly, but which can be corrected in a negative element during printing). Masking couplers are described further below.

By integrated spectral sensitivity referenced in the present case, is meant the integral of a spectral sensitivity curve. In particular, this represents the area under the curve of spectral sensitivity (that is, the curve of sensitivity versus wavelength) and is defined by the following equation:

$$ISS=\int SS(\lambda)\cdot d\lambda$$

where ISS is the integrated spectral sensitivity and SS is the spectral sensitivity. Integrated spectral sensitivity can be obtained in any of a number of ways. One simple way to obtain relative (i.e. one expressed as a percentage of the other) integrated spectral sensitivity values is to obtain sensitivity versus wavelength plots (both, of course, on a linear scale) on a paper of uniform weight, on each plot cut out the total area under the curve over the wavelength of interest and precisely weigh the cut out paper. The relative weights of the paper represent the relative integrated spectral sensitivities of the plots over the wavelength of interest.

Preferably, the blue sensitive silver halide emulsion layer satisfies the following spectral sensitivity requirements:

$$426\text{ nm} \leqq \lambda_{Bmax} \leqq 444\text{ nm}$$

$$S_{\{400-(\lambda Bmax-15),(\lambda Bmax+15)-500\}} < 65\%(S_{\lambda Bmax})$$

$$IS_{(425-450)} \geqq 25\%(IS_{(400-500)})$$

in which $\lambda_{Bmax}$ is the wavelength of maximum blue sensitivity of the blue sensitive layer; $S_{\lambda Bmax}$ is the sensitivity at $\lambda_{Bmax}$; $S_{\{400-(\lambda Bmax-15),\ (\lambda Bmax+15)-500\}}$ is the sensitivity anywhere within the region 400 to 500 nm except the region within ±15 nm of $\lambda_{Bmax}$ (for example if $\lambda_{Bmax}$ =435 nm then the foregoing region would be 400–420 nm together with 450–500 nm); $IS_{(425-450)}$ and $IS_{(400-500)}$ are as defined above.

A color element of the present invention type is typically a negative element (in that it is designed to form a negative image following processing), and may have various red and green spectral sensitivity profiles. However, it is preferred that it has a maximum red sensitivity of between 600–660 nm. Within the foregoing range, maximum red sensitivities between 600–640 nm or between 640–660 nm can be used. Preferably the red sensitivity of the red sensitive record of the element is between 600–640 nm. Using the 600–640 nm range allows the element to have a red sensitivity more similar to that of the human eye and to better match the emission spectra of fluorescent lights As to the green sensitive record of the element, this should preferably have a maximum sensitivity between 530–570 nm.

Preferably, the blue sensitive layer has a blue sensitivity at a wavelength of 485 nm, $S_{485}$, such that $S_{485} \leqq 30\%(S_{Bmax})$. More particularly, the foregoing could be $\leqq 20\%(\lambda_{Bmax})$. With regard to $S_{max(426-444\ nm)}$, this could be $\geqq 75\% S_{max(400-500\ nm)}$ or even $\geqq 85\% S_{max(400-500\ nm)}$. Similarly, $IS_{(425-450)}$ could be $\geqq 35\%(IS_{(400-500)})$ or even $\geqq 45\%$ or 50% of $(IS_{(400-500)})$. While, as described above, $\lambda_{Bmax}$ is from 426 to 444 nm, $\lambda_{Bmax}$ could be from 430 to 440 nm or even 432 to 438 nm (or even 433–437 nm). Also, $S_{\{400-(\lambda Bmax-15),\ (\lambda Bmax+15)-500\}}$ could be less than $55\%(S_{\lambda Bmax})$ or even less than 45% or 35% of $S_{\lambda Bmax}$. As to $IS_{(425-450)}$, this could be $\geqq 35\%(IS_{(400-500)})$ or even $\geqq 45\%$ or 55% of $IS_{(400-500)}$). It will be understood in this application that when any sensitivity parameters of a particular emulsion, layer or record of an element is referenced, this means the sensitivity as measured in the element.

As to the silver halide emulsion used for the blue sensitive layer, it is preferably a tabular emulsion and further preferably a tabular silver bromoiodide emulsion in which, of all halide present, chloride is less than 10% and iodide is less than 10% (and more preferably less than 6% chloride and 6% iodide). Preferably, the tabular grain emulsion will be silver bromoiodide. Unless otherwise indicated throughout this application, all percentages are by moles.

A color negative of the present invention will usually have the blue record made up of one or more blue sensitive layers. In such case, all blue sensitive layers taken together can be considered a single layer for the purposes of the present invention. That is, where there is more than one blue sensitive layer, then when considered together they should meet the limitations of the present invention.

As to the printing process, the automatic printer typically adjusts the red exposure, $E_r$, green exposure, $E_g$, or blue exposure, $E_b$, (this includes adjustment of any two or all three, as required) based on the difference in color saturation of the subject negative relative to a standard negative, D'. Typical automatic printers on which a film of the present invention may be printed, include those described above which have printer algorithms set for: (1) no color correction; (2) a 50% or some other percentage color correction; (3) or hue dependent color correction. These three types of color correction are described in more detail below:

(1) No Color Correction

The printer assesses the overall negative density relative to the setup negative (that is, the standard negative). The printer changes the R, G, and B exposures ("R", "G" and "B" refer to red, green and blue, respectively) to compensate for the deviation in average negative density from that of the setup negative, but the ratios of R, G, and B exposures for the new negative exposure to those for the setup negative are the same (Red ratio=Green ratio=Blue ratio, R'/R=G'/G=B'/B; where R', G' and B' indicate the exposures given to the standard negative during printing and R, G, and B indicate the exposures to the subject negative).

(2) 50% (or some percent significantly less than 100%, usually if not always less than 75%) Color Correction The printer assess the overall negative density relative to the normal setup negative and determines the R, G, and B exposure time ratios for the new negative relative to the setup negative. These exposure times are then adjusted to provide some color correction. The color correction is determined by calculating the color saturation of the new negative relative to the setup negative. One way which is commonly used to assess negative color saturation is described by E. Goll in the article referenced above (which is incorporated herein by reference). The average R, G, and B film densities are determined by the printer and compared to those for the setup negative. The density differences are calculated as described on page 95 of the reference. A T-space conversion matrix is applied to these density differences as described on page 97 of the reference. Finally, film saturation is calculated from these parameters as described on page 99 of the reference. After determining the negative saturation, the printer corrects for 50% of the film saturation by adjusting the R, G, and B exposures relative to what is needed for a neutral correction only. The actual adjustment of the R, G, and B exposures is accomplished using the film saturation value and the hue of the film saturation (described on page 99 of the reference), in a way which compensates for the hue of the negative (for example, if the film has a magenta bias, the green exposure is increased and the red and blue exposures are decreased to remove 50% of the color saturation in the negative on printing).

(3) Hue-dependent Color Correction

Printers using this kind of algorithm proceed exactly as the constant percent correction printers do until the film hue and saturation are calculated. The printer then makes a correction dependent on the hue of the film color bias relative to the setup negative, and from the saturation level of the film color bias. In this adaptive algorithm, the printer corrects maximally for small film color biases and to an increasingly smaller degree as the film color saturation increases. The amount of correction is determined by a printer color space (often called T-space) boundary. It the film color saturation is greater than the boundary, no color correction is made. The distance from the boundary to the central neutral point varies depending on the film color bias hue, in such a way as to allow the printer to make large corrections for film color biases which are introduced by typical illuminant variations, such as sunset and north skylight for daylight illumination. This kind of algorithm is described in detail in the article by E. Goll referenced above.

The blue sensitive layer of elements of the present invention preferably has a $\lambda_{Bmax}$ between 430–440 nm (or even 433–437 nm). Additionally, the blue sensitive layer in elements of the present invention, can also have substantial sensitivity in the 450–500 nm region and can even be sensitized by a spectral sensitizing dye in the foregoing region. In fact, substantial sensitivity in the 450–500 nm region will provide the blue sensitive layer with increased blue speed under some lighting conditions. For example, elements with a blue sensitive emulsion layer meeting the requirements described in U.S. patent application entitled "Photographic Element Containing Particular Blue Sensitized Tabular Grain Emulsion and Method of Processing Such Element", by Kam-Ng et al. and filed on the same date as the present application (Attorney Docket Number 64,086) (this reference, and all other references cited in this application are incorporated herein by reference) can simultaneously meet the requirements of that application and the present invention. In particular, the blue sensitive layer of the present invention can be a silver halide tabular grain emulsion layer having less than 80% silver chloride and the grains of which have a tabularity of at least 8 sensitized such that the wavelength of maximum sensitivity of the layer between 400–500 nm, $\lambda_{Bmax}$, the sensitivity at 485 nm, $S_{485}$, the sensitivity at 410 nm, $S_{410}$, and the sensitivity at $\lambda_{Bmax}$, $S_{Bmax}$, are defined by:

$$430\text{ nm} \leqq \lambda_{Bmax} \leqq 440\text{ nm or } 450\text{ nm} \leqq \lambda_{Bmax} \leqq 480\text{ nm}$$

and:

$$S_{485} \leqq 50\%(S_{Bmax})$$

$$S_{410} \leqq 60\%(S_{Bmax})$$

and the maximum sensitivity of the layer between 430–440 nm, $S_{(430-440)max}$, and the maximum sensitivity between 450–480 nm, $S_{(450-480)max}$, have the following relationship:

$$90\%(\lambda_{(450-480)max}) \leqq \lambda_{(430-440)max} \leqq 110\%(\lambda_{(450-480)max}).$$

However, the blue sensitive layer of elements of the present invention must meet the sensitivity requirements of the present invention as already defined. A color element of the above defined type will usually have a blue record made up of one or more blue sensitive layers. Typically, each blue sensitive layer will be of the type defined above (that is, a blue sensitive tabular grain silver halide emulsion layer of the type and sensitivity defined above). However, the present invention can include the possibility of a blue sensitive layer being other than the defined blue sensitive tabular grain silver halide emulsion.

The necessary spectral sensitivity characteristics of the blue sensitive silver halide tabular grain emulsion layer defined above, can be obtained by adjusting the inherent sensitivity of the emulsion in a known manner or by using a sensitizing dye (particularly on tabular grain emulsions). For example, a sensitizing dye can be used which will provide a peak sensitivity on the emulsion between 426–444 nm (more preferably 430–440 nm or even 433–437 nm). If sensitivity at 450–500 nm is also desired then a second appropriate sensitizing dye can be used which will provide a peak in that region. The amounts of such dyes used can then be adjusted to provide the desired sensitivity in the 450–500 nm while maintaining the necessary sensitivity profile of the present invention as already defined above Since the spectral absorption characteristics of a sensitizing dye on an emulsion will, to some extent, depend on the particular emulsion used as well as other sensitizing dyes present on the same emulsion, the sensitizing dyes selected to sensitize the blue sensitive tabular silver halide emulsion to within the required characteristics will have to be selected bearing in mind these characteristics. Furthermore, in case where more than one dye is used, the spectral sensitivity profile of the emulsion can be manipulated not only by the dyes used but also through factors such as the order of addition, the environment (VAg), the emulsion surface and other factors. The dyes can be added as solutions or as dispersions as prepared by the means including the type of process outlined in Boettcher et al U.S. Pat. No. 5,217,859 and references therein. Potentially suitable dyes include those types described in T. H. James, editor, *The Theory of the Photographic Process,* 4th Edition, Macmillan, N.Y. 1977, Chapter 8, and in F. M. Hamer, *Cyanine Dyes and Related Compounds,* Wiley, N.Y., 1964, or U.S. Pat. No. 4,439,520 page 26 line 61 to page 34. Alternatively, one can blend the required type of emulsions each sensitized with different sensitizing dyes (for example a "short dye" providing a peak sensitivity in the 426–444 nm region, and a "long" dye providing a peak sensitivity in the 450–500 nm region) and the final blend has the necessary blue spectral sensitivity profile.

Many spectral sensitizing dyes are capable of aggregating (particularly of forming J aggregates) on silver halide (for example, silver bromide or bromoiodide) tabular grain surfaces in the 426–444 nm region, some particular examples are shown in Table 1, below. Also, U.S. patent application entitled "Photographic Elements Containing Particular Blue Sensitized Tabular Grain Emulsion" by Reed et al., filed on the same date as the present application (Attorney Docket No. 63655), discloses dyes which can usefully sensitize in the foregoing short and long regions. Some examples of spectral sensitizing dyes sensitizing an emulsion in the 450–480 nm region are shown in Table 2.

Table 1

YD-1 Anhydro-5-chloro-5'-phenyl-3,3'-bis(3-sulfopropyl)oxathiacyanine hydroxide, triethylammonium salt.

YD-2 3,3'-Dimethyl-6-azanaphtho[1,2-d]thiazolocyanine p-toluenesulfonate.

YD-3 Anhydro-5,6-dichloro-3-ethyl-1,1'-bis(3sulfopropyl)benzimidazolonaphth[1,2-d]oxazolocyanine hydroxide, potassium salt.

YD-3a Anhydro-5,6-dichloro-1-ethyl-5'-phenyl-3,3'-di(3-sulfopropyl)benzimidazoloxzcynine hyroxide, potassium salt.

YD-4 Anhydro-5,5'di(methylthio)-3,3'bis(3sulfopropyl)oxathiacyanine hydroxide, triethylammonium salt.

YD-5 Anhydro-5'-methoxy-3,3'-bis(3sulfopropyl)naphth[2,3-d]oxazolothiacyanine hydroxide triethylammonium salt.

YD-6 5,5'6,6'-Tetrachloro-1,1', 3,3'-tetramethylbenzimidazolocyanine p-toluenesulfonate.

YD-7 5,5',6,6'-tetrachloro-1,1'-dimethyl-3,3'methylenebenzimidazolocyanine iodide.

YD-8 Anhydro-3,3'-bis(3-sulfopropylnaphtho[1,2-d]-thiazolooxacyanine hydroxide triethylammonium salt.

YD-9 Anhydro-3,3'-bis(3-sulfopropyl)-5-(2-thienyl)-oxa-4',5'-dihydronaphtho[1,2-d]thiazolocyanine hydroxide, triehtylammonium salt.

Table 2

YD-10 Anhydro-5,5'-dichloro-3-ethyl-3'-(3-sulfopropyl)thiacyanine hydroxide.

YD-11 Anhydro-5-chloro-3'-ethyl-3-(3-sulfopropyl) naphtho[1,2-d]thiazolothiacyanine hydroxide.

YD-12 Anhydro-5,5'-di(methylthio)-3,3'-bis(3sulfopropyl)thiacyanine hydroxide, triethylammonium salt.

YD-13 Anhydro-1'-ethyl-3-(3-sulfopropyl) naphtho[1,2d] thiazolothiacyanine hydroxide.

YD-14 Anhydro-5-chloro-3,3'-bis(3-sulfopropyl)thiacyanine hydroxide, triethylammonium salt.

YD-15 Anhydro-3-(3-carboxypropyl)-5,5'-dichloro-3'-ethylthiacyanine hydroxide.

YD-16 Anhydro-5'-methylthio-l,3'bis(3sulfopropyl)naphtho [1,2-d]thiazolothiacyanine hydroxide, triethylamine salt.

YD-17 Anhydro-5-chloro-3'-ethyl-3-(4sulfobutyl)thiacyanine hydroxide.

YD-18 Anhydro-5,5'-diphenyl-3,3'bis(3-sulfopropyl)thiacyanine hydroxide, triethylammonium salt.

YD-19 Anhydro-1,3'-bis(3-sulfopropyl)naphtho[1,2-d]thiazolothiacyanine hydroxide, triethylammonium salt.

YD-20 Anhydro-5,5'-dimethoxy-3,3'-bis(3-sulfopropyl) thiacyanine hydroxide, sodium salt.

YD-21 Anhydro-3-(2-carboxy-2-sulfoethyl)-3'-ethyl-5-methoxythiacyanine hydroxide, potassium salt.

YD-22 Anhydro-1-ethyl-3'-(2phosphonoethyl)naphtho[1,2-d]thiazolothiacyanine hydroxide.

YD-23 Anhydro-3-ethyl-5'-methoxy-5-methylthio-3'-(3sulfopropyl)thiacyanine hydroxide.

YD-24 Anhydro-5-phenyl-3,3'bis(3-sulfopropyl)-4',5'dihydronaphtho[1,2-d]thiazolothiacyanine hydroxide, triethylamine salt.

YD-25 Anhydro-3-ethyl-5,5'-dimethyoxy-3'-(3sulfopropyl)thiacyanine hydroxide.

YD-26 Anhydro-5,5'-dichloro-3,3'-bis(3sulfopropyl)thiacyanine hydroxide, triethylammonium salt.

As already described above, color photographic elements contain dye image-forming units sensitive to each of the three primary regions of the spectrum. Each unit (sometimes referred to as a "record") can be one or more layers sensitive to a given region of the spectrum (for example, blue light). The units of the element, including the layers of the image-forming units, can be arranged in various orders as known in the art although the order described above (red sensitive on a transparent support first, followed by green sensitive then blue sensitive) is preferred. In a less preferred alternative format, the emulsions sensitive to each of the three primary regions of the spectrum can be disposed as a single segmented layer.

The element can contain additional layers, such as filter layers, interlayers, overcoat layers, subbing layers, antihalation layers and the like. All of these can be coated on a support which could be opaque (for example, paper or, more typically, transparent. Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. This and other Research Disclosures references herein are published by Kenneth Mason Publications, Ltd., Dudley Annex, 12a North Street, Emsworth, Hampshire P010 7DQ, ENGLAND. The element typically will have a total thickness (excluding the support) of from 5 to 30 microns.

In the following discussion of suitable materials for use in elements of this invention, reference will be made to *Research Disclosure*, December 1989, Item 308119. *Research Disclosure,* December 1989, Item 308119, will be identified hereafter by the term "Research Disclosure I." The Sections hereafter referred to are Sections of the Research Disclosure I.

The silver halide emulsions employed in the elements of this invention will be negative-working, such as surface-sensitive emulsions or unfogged internal latent image forming emulsions. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072, 632; 90-072,633; 90-072,634; 90-077,822; 90-078,229 ; 90-078,230; 90-079,336; 90-079,338; 90-079,690 ; 90-079,691; 90-080,487; 90-080,489; 90-080,490 ; 90-080,491; 90-080,492; 90-080,494; 90-085,928 ; 90-086,669; 90- 086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The light sensitive layers of the element of the present invention may employ any suitable silver halide such as silver iodobromide (preferred for all layers), silver bromide, silver chloride, silver chlorobromide, silver chloroiodobromide, and the like. The type of silver halide grains preferably include polymorphic, cubic, octahedral or tabular. However, as already mentioned, the blue sensitive layer in particular preferably uses as the silver halide, a tabular grain emulsion of the type already specified.

The range of iodide content in a silver bromoiodide tabular grain emulsion of the blue sensitive layer as required by the present invention, can be 0.1% to 9%, preferably 0.2% to 8%, and most preferably 0.5% to 6%. The grain size of the silver halide in such layer may have any distribution known to be useful in photographic compositions, and may be either polydispersed or monodispersed. Particularly useful in this invention, and preferably used as the silver halide in the blue sensitive layer, is a tabular grain silver halide.

The emulsions can be either non-tabular grain or tabular grain emulsions, where tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions, that is emulsions wherein ECD/t>8, where ECD is the diameter of a circle having an area equal to grain projected area and t is tabular grain thickness; intermediate aspect ratio tabular grain emulsions, that is ECD/t=5 to 8; or low aspect ratio tabular grain emulsions, that is ECD/t=2 to 5. The emulsions typically exhibit high tabularity (T), where $T=ECD/t^2$, that is $ECD/t^2>25$, and ECD and t are both measured in micrometers (μm). The emulsion can further have a tabularity of >40 or even >100 or >1000. The tabular silver halide emulsions for the blue sensitive layer preferably have a tabularity of from 25 to 4000, and more preferably from 100 to 1500).

The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum grain surface to volume ratios. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858 and 5,221,602, Wey et al U.S. Pat. No. 4,414,306, Daubendiek et al U.S. Pat. Nos. 4,414,310, 4,672,027, 4,693,964 and 4,914,014, Abbott et al Pat. No. 4,425,426, Solberg et al U.S. Pat. No. 4,433,048, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S. Pat. No. 4,801,523, Tufano et al U.S. Pat. No. 4,804,621, Ikeda et al U.S. Pat. No. 4,806,461 and EPO 0 485 946, Bando U.S. Pat. No. 4,839,268, Makino et al U.S. Pat. No. 4,853,322, Nishikawa et al U.S. Pat. No. 4,952,491, Houle et al U.S. Pat. No. 5,035,992, Piggin et al U.S. Pat. Nos. 5,061,609 and 5,061,616, Nakamura et al U.S. Pat. No. 5,096,806, Bell et al U.S. Pat. No. 5,132,203, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Antoniades et al U.S. Pat. No. 5,250,403, Zola et al EPO 0 362 699, Maruyama et al EPO 0 431 585, Urabe EPO 0 460 656, Verbeek EPO 0 481 133, 0 503 700 and 0 532 801, Jagannathan et al EPO 0 515 894 and Sekiya et al EPO 0 547 912. Emulsions containing {100} major face tabular grains are illustrated by Bogg U.S. Pat. No. 4,063,951, Mignot U.S. Pat. No. 4,386,156, Maskasky U.S. Pat. Nos. 5,264,337 and 5,275,930, Brust et al EPO 0 534 395 and Saitou et al EPO 0 569 971.

The silver halide grains to be used in the invention may be prepared according to methods known in the art, such as those described in *Research Disclosure I* and James, *The Theory of the Photographic Process,* or U.S. Pat. No. 4,439,520 for precipitation of iodobromide tabular grains. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure,* June 1975, item 13452 and U.S. Pat. No. No. 3,772,031.

The silver halide may be sensitized by sensitizing dyes by any method known in the art, such as described in *Research Disclosure I.* Of course, the blue sensitive tabular silver halide emulsion will be sensitized to meet the requirements as described above. The dye or dyes may be added to an emulsion of the silver halide grains and a hydrophilic colloid at any time prior to (e.g., during or after chemical sensitization) or simultaneous with the coating of the emulsion on a photographic element. However, for tabular grain emulsions, the dye should be added during chemical sensitization. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVIII. This typically involves imagewise exposure to light in the visible region of the spectrum (particularly including fluorescent light, that is, light from typical fluorescent light sources).

Photographic elements comprising the composition of the invention can be processed in any of a number of well-known photographic processes which form negative dye images, utilizing any suitable processing composition, described, for example, in *Research Disclosure I,* or in James, *The Theory of the Photographic Process* 4th, 1977. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

Following the processing step, a negative of the present invention is then used to produce a print preferably on an automatic printer of the type, and in the manner, already described above.

The invention is described further in the following examples.

EXAMPLES

The improvement in color print quality as a result of the invention blue spectral sensitivity can be illustrated in a full multi-color film format. The films labeled EXAMPLES 1 through 5 were constructed as described below. EXAMPLE 1 is a comparative film having a single peak blue sensitivity at 470 nm and which does not have a blue layer meeting the requirements of the present invention. EXAMPLES 2 through 6 are films of the present invention.

EXAMPLE 1 has the format described below:

The following layers are coated onto a clear acetate film support in the order cited. The coverages are in mg per square meter of the named component except in the case of emulsions where the coverages are in mg of silver per square meter. The designation "DIR" represents "development releasing inhibitor" and is used to denote those couplers which release an inhibitor during development.

| | Coverage |
|---|---|
| Layer 1 - Antihalation Layer Coverage | |
| black filamentary silver | 150 |
| UV absorbing dye (UV-1) | 75 |
| UV absorbing dye (UV-2) | 32 |
| oxidized developer scavenging coupler (C-1) | 160 |
| magenta dye forming coupler (C-2) | 39 |
| magenta filter dye (FD-1) | 38 |
| cyan filter dye (FD-2) | 8 |
| yellow filter dye (FD-3) | 14 |
| gelatin | 2152 |
| Layer 2 - Slow Cyan Layer | |
| cyan emulsion (CE-1) | 607 |
| cyan emulsion (CE-2) | 340 |
| cyan emulsion (CE-3) | 535 |
| cyan dye forming coupler (C-3) | 495 |
| cyan dye forming DIR coupler (C-4) | 43 |
| cyan dye forming coupler (C-5) | 54 |
| gelatin | 2152 |
| Layer 3 - Fast Cyan Layer | |
| cyan emulsion (CE-4) | 861 |
| cyan dye forming coupler (C-3) | 81 |
| cyan dye forming DIR coupler (C-4) | 34 |
| cyan dye forming coupler (C-6) | 43 |
| gelatin | 1615 |
| Layer 4 - Interlayer | |

-continued

| | Coverage |
|---|---|
| gelatin | 1292 |
| Layer 5 - Slow Magenta Layer | |
| magenta emulsion (ME-1) | 458 |
| magenta emulsion (ME-2) | 196 |
| magenta dye forming coupler (C-7) | 250 |
| gelatin | 1635 |
| Layer 6 - Mid Magenta Layer | |
| magenta emulsion (ME-3) | 108 |
| magenta emulsion (ME-4) | 409 |
| magenta dye forming coupler (C-7) | 84 |
| magenta dye forming coupler (C-8) | 151 |
| yellow dye forming DIR coupler (C-9) | 16 |
| gelatin | 1479 |
| Layer 7 - Fast Magenta Layer | |
| magenta emulsion (ME-5) | 689 |
| magenta dye forming coupler (C-7) | 57 |
| magenta dye forming DIR coupler (C-10) | 3 |
| magenta dye forming coupler (C-8) | 54 |
| gelatin | 1263 |
| Layer 8 - Yellow Colloidal Silver Filter Layer | |
| colloidal silver | 59 |
| oxidized developer scavenging coupler (C-11) | 52 |
| gelatin | 861 |
| Layer 9 - Slow Yellow Layer | |
| yellow emulsion (YE-1b) | 484 |
| yellow dye forming coupler (C-12) | 161 |
| yellow dye forming coupler (C-13) | 742 |
| yellow dye forming DIR coupler (C-14) | 32 |
| gelatin | 1776 |
| Layer 10 - Fast Yellow Layer | |
| yellow emulsion (YE-2b) | 377 |
| yellow dye forming coupler (C-12) | 140 |
| yellow dye forming coupler (C-13) | 237 |
| yellow dye forming DIR coupler (C-14) | 64 |
| yellow filter dye (FD-4) | (as needed to adjust speed) |
| gelatin | 1076 |
| Layer 11 - UV Absorbing Layer | |
| Lippman AgBr emulsion | 108 |
| UV absorbing dye (UV-1) | 108 |
| UV absorbing dye (UV-2) | 108 |
| gelatin | 1076 |

A hardener, bis(vinylsulfonylmethyl) ether is added to maintain layer integrity during processing. The amount of yellow filter dye (FD-4) used in Layer 10 was adjusted to give equal yellow speeds as the sensitizing dyes in the slow and fast yellow layers were changed. A detailed description of the emulsions follows:

CE-1 is an iodobromide tabular grain emulsion. The total iodide content is 1.5% and the iodide is added at 70% of the precipitation. The average grain size in equivalent circular diameter (ECD) is 0.61 microns, the average thickness is 0.115 microns and the average tabularity is 46.1. The emulsion follows a typical sulfur and gold sensitization and the spectral sensitizing dyes are CD-1 and CD-2 at a 1:9 molar ratio.

CE-2 is an iodobromide tabular grain emulsion. The total iodide content is 4.1% of which 1.1% is added through 70% of the precipitation and 3% is added at the 70% point. The average grain size in ECD is 0.94 microns, the average thickness is 0.115 microns and the average tabularity is 71.1. The emulsion follows a typical sulfur and gold sensitization and the spectral sensitizing dyes are CD-1 and CD-2 at a 1:9 molar ratio.

CE-3 is an iodobromide tabular grain emulsion. The total iodide content is 4.1% of which 1.1% is added through 70% of the precipitation and 3% is added at the 70% point. The average grain size in ECD is 1.22 microns, the average thickness is 0.118 microns and the average tabularity is 87.6. The emulsion follows a typical sulfur and gold sensitization and the spectral sensitizing dyes are CD-1 and CD-2 at a 1:9 molar ratio.

CE-4 is an iodobromide tabular grain emulsion. The total iodide content is 4.1% of which 1.1% is added through 70% of the precipitation and 3% is added at the 70% point. The average grain size in ECD is 2.25 microns, the average thickness is 0,128 microns and the average tabularity is 137.3. The emulsion follows a typical sulfur and gold sensitization and the spectral sensitizing dyes are CD-1 and CD-2 at a 1:9 molar ratio.

ME-1 is an iodobromide tabular grain emulsion. The total iodide content is 1.5% and the iodide is added at 70% of the precipitation. The average grain size in ECD is 0.54 microns, the average thickness is 0.085 microns and the average tabularity is 74.7. The emulsion follows a typical sulfur and gold sensitization and the spectral sensitizing dyes are MD-1 and MD-2 at a 1:4 molar ratio.

ME-2 is an iodobromide tabular grain emulsion. The total iodide content is 4.1% of which 1.1% is added through 70% of the precipitation and 3% is added at the 70% point. The average grain size in ECD is 0.87 microns, the average thickness is 0.091 microns and the average tabularity is 105.1. The emulsion follows a typical sulfur and gold sensitization and the spectral sensitizing dyes are MD-1 and MD-2 at a 1:4 molar ratio.

ME-3 is an iodobromide tabular grain emulsion. The total iodide content is 4.1% of which 1.1% is added through 70% of the precipitation and 3% is added at the 70% point. The average grain size in ECD is 1.16 microns, the average thickness is 0,114 microns and the average tabularity is 89.3. The emulsion follows a typical sulfur and gold sensitization and the spectral sensitizing dyes are MD-1 and MD-2 at a 1:4 molar ratio.

ME-4 is an iodobromide tabular grain emulsion. The total iodide content is 4.1% of which 1.1% is added through 70% of the precipitation and 3% is added at the 70% point. The average grain size in ECD is 1.30 microns, the average thickness is 0.127 microns and the average tabularity is 80.6. The emulsion follows a typical sulfur and gold sensitization and the spectral sensitizing dyes are MD-1 and MD-2 at a 1:4 molar ratio.

YE-1b(470 nm) is an iodobromide tabular grain emulsion. The total iodide content is 2.7% and the iodide is added continually from 17 to 95% of the make. The average grain size in ECD is 1.38 microns with an average thickness of 0.047 microns and average tabularity of 625. The emulsion was sensitized with 2.2 mmoles YD-26 and sulfur and gold according to the procedure described for Comparative Example Control A in U.S. patent application Ser. No. 169,478, filed Dec. 16, 1993.

YE-2b (470 nm) is an iodobromide tabular grain emulsion. The total iodide content is 2.7% and the iodide is added continually from 17 to 95% of the make. The average grain size in ECD is 2.29 microns with an average thickness of 0.059 microns and an average tabularity of 658. The emulsion was sensitized with 1.6 mmoles of sensitizing dye YD-26 and sulfur and gold according to the procedure described for Comparative Example Control A in U.S. patent application Ser. No. 169,478, filed Dec. 16, 1993.

The other constituents of the multilayer format were as follows:

CD-1 is benzoxazolium, 2-(2-((5,6-dimethoxy-3-(3-sulfopropyl)-2(3H) -benzothiazolylidene)methyl)-1-butenyl)-5-phenyl-3- (3-sulfobutyl)-, inner salt, sodium salt.

CD-2 is anhydro-5,5'-dichloro-9-ethyl-3,3'-bis(3-sulfopropyl)thiacarbocyanine hydroxide, ion salt.

MD-1 is anhydro-6,6'dichloro-1,1'-diethyl-3,3'-bis(3-sulfopropyl)-5,5'-ditrifluoromethylbenzimidazolocarbocyanine hydroxide, sodium salt.

MD-2 is anhydro-5-chloro-9-ethyl-5'-phenyl-3'-(3-sulfobutyl)-3-(3- sulfopropyl)oxacarbocyanine hydroxide, sodium salt.

UV-1 is propanedinitrile, (3- (dihexylamino) -2-propenylidene).

UV-2 is 2 -propenoic acid, 2 -cyano-3 - ( 4-methoxyphenyl ) -, propyl ester.

FD- 1 is benzamide, 3 - (((2,4-bis (1,1-dimethylpropyl)phenoxy)acetyl)amino)-N-(4- ((4(ethyl(2 -hydroxyethyl)amino)-2-methylphenyl)imino)-4,5-dihydro-5-oxo-1- -(2,4,6-trichlorophenyl)-1H-pyrazol-3 -yl)-.

FD-2 is 2-naphthalenecarboxamide, N-(4-(2,4-bis(1,1-dimethylpropyl)phenoxy)butyl)-4-((4-(ethyl(2hydroxyethyl)amino)-2-methylphenyl)imino)-1,4-dihydro1-oxo-.

FD-3 is benzamide, 3-(((2,4-bis (1,1-dimethylpropyl)phenoxy)-acetyl)amino)-N-(4- ((4diethylamino)phenylmethylene)-4,5 -dihydro-5-oxo -1-(2,4,6-trichlorophenyl)-1H-pyrazol-3-yl ).

FD-4 is 1H-Pyrazole-3-carboxylic acid, 4,5-dihydro-5-oxo-1-(4-sulfophenyl)-4- ((4-sulfophenyl)azo)-, trisodium salt.

C-1 is 1,4-benzenediol, 2,5-bis(1,1,3,3-tetramethylbutyl)-.

C-2 is benzamide, 3-(((2,4-bis (1,1dimethylpropyl)phenoxy)acetyl)amino)-N-(4,5-dihydro-4((4-methoxyphenyl)azo)-5-oxo-1-(2,4,6-trichlorophenyl)-1H- pyrazol-3-yl)-.

C-3 is hexanamide, 2-(2,4-bis (1,1-dimethylpropyl)phenoxy)-N-(4-((((4-cyanophenyl)amino)carbonyl)amino)-3-hydroxyphenyl)-.

C-4 is 2-naphthalenecarboxamide, 1-hydroxy-4-(4-(((1((4-methoxyphenyl)methyl)- 1H-tetrazol-5-yl)thio)methyl)-2-nitrophenoxy)-N-(2-(tetradecyloxy)phenyl)-.

C-5 is propanoic acid, 3-((3-(((4-(2,4 bis(1,1-dimethylpropyl)phenoxy)butyl)amino)carbonyl)-4-hydroxy1-naphthalenyl)thio)-.

C-6 is 2,7-naphthalenecarboxamide, 1-hydroxy-4-(4-(((1-((4- methoxyphenyl)methyl)-1H-tetrazol-5-yl)thio)methyl)-2-nitrophenoxy)-N-(2-(tetradecyloxy)phenyl)-.

C-7 is tetradecanamide, N-(3-((4-((2-(2,4-bis-(1,1-dimethylpropyl)phenoxy)-1-oxobutyl)amino)phenyl)thio)-4,5-dihydro-1-(2,4,6-trichlorophenyl)-1H-pyrazol-3-yl) amino)-4-chlorophenyl)-, dipyridium salt.

C-8 is tetradecanamide, N-(4-chloro-3-((4-((3,4-dimethoxyphenyl)azo)-4,5- dihydro-5-oxo-1-(2,4,6-trichlorophenyl)-1H-pyrazol-3-yl)amino)phenyl)-2-(3(1,1-dimethylethyl)-4-hydroxyphenoxy)-.

C-9 is benzotriazolecarboxylic acid, 1 (or 2)-(2-((2-chloro-5-((2-(dodecyloxy)- 1-methyl- 2-oxoethoxy)carbonyl)phenyl)amino)-1-(((2-chloro-5-((2-(dodecyloxy)- 1-methyl-2-oxoethoxy)carbonyl)phenyl)amino)carbonyl-2-oxoethyl)-, phenyl ester.

C-10 is butanamide,2-(2,4-bis(1,1-dimethylpropyl)phenoxy)-N-(4-(4,5-dihydro-5- oxo-4-((1-phenyl-1H-tetrazol-5-yl)thio)-3-(1-pyrolidinyl)-1H-pyrazol-1- yl)phenyl)-.

C-11 is benzenesulfonamide, N,N'-(4-hydroxy-1,3-phenylene)bis(4-(dodecyloxy)-.

C-12 is benzoic acid, 4-chloro-3-((2-(4-ethoxy-2,5-dioxo-3-(phenyl)methyl)-1- imidazolidinyl)-3-(4-methoxyphenyl)-1,3-dioxopropyl)amino)-, dodecyl ester.

C-13 is benzoic acid, 4-chloro-3-((2-(4-ethoxy-2,5-dioxo-3-(phenyl) methyl)-1- imidazolidinyl)-4,4-dimethyl-1,3-dioxopentyl)amino)-, dodecyl ester.

C-14 is 1H-tetrazole-1-acetic acid, 5-(2-(1-(((2-chloro-5-((hexadecylsulfonyl)amino)phenyl)amino)carbonyl)-3,3-dimethyl-2-oxobutoxy)-5-nitrophenyl)methyl)ethylamino)carbonyl)thio)-, propyl ester.

The other examples were prepared as follows:

EXAMPLE 2 is identical to EXAMPLE 1 except YE-3b and YE-4b were used in place of YE-1*b* and YE-2b.

YE-3b (437 run) is prepared from the same emulsion as YE-1b and uses the same sensitizing procedure except the sensitizing dye is YD-3.

YE-4b (437 nm) is prepared from the same emulsion as in YE-2b and uses the same sensitizing procedure except the sensitizing dye is YD-3.

EXAMPLE 3 is identical to EXAMPLE 1 except YE-5b and YE-6b were used in place of YE-1b and YE-2b.

YE-5b (438, 469 nm double) is prepared from the same emulsion as in YE-1b and uses the same sensitizing procedure except the emulsion is treated with 1.1 mmole of YD-3 and 1.1 mmole of YD-26 in place of 2.2 mmole of YD- 1.

YE-6b (438, 469 nm double) is prepared from the same emulsion as in YE-2b and uses the same sensitizing procedure except the emulsion is treated with 0.8 mmole YD-3 and 0.8 mmole YD-26 in place of 1.6 mmole of YD-26.

EXAMPLE 4 is identical to EXAMPLE 1 except YE-7b and YE-8b were used in place of YE-1b and YE-2b.

YE-7b (440 nm) is prepared from the same emulsion as in YE-1b and uses the same sensitizing procedure except the sensitizing dye is YD-1.

YE-8b (440 nm) is prepared from the same emulsion as in YE-2b and uses the same sensitizing procedure except the sensitizing dye is YD-1.

EXAMPLE 5 is identical to EXAMPLE 1 except YE-9b and YE-10b were used in place of YE-1b and YE-2b.

YE-9b (428 nm) is prepared from the same emulsion as in YE-1b and uses the same sensitizing procedure except the sensitizing dye is YD-3a.

YE-10b (428 nm) is prepared from the same emulsion as in YE-2b and uses the same sensitizing procedure except the sensitizing dye is YD-3a EXAMPLE 6 is identical to EXAMPLE 1 except 560 mg per square meter (mg/sqm) YE- 4a was used in place of YE-1b and 312 mg/sqm YE-4a, 108 mg/sqm YE-2a, and 161 mg/sqm YE-1a were used in place of YE-2b.

The measured spectral sensitivity profiles of the blue sensitive record of Example 1, is shown in FIG. 1. Similarly, the spectral sensitivity profiles of the blue sensitive records of Examples 2 to 6, are shown in FIGS. 2 to 6, respectively.

Each of several light sources was used to photograph a gray target with the six films. The light sources included Warm White Deluxe fluorescent, Cool White fluorescent, Ultralume(economy fluorescent), Mercury Vapor lights and a simulated daylight ("HMI"). The films were processed in standard C-41 chemistry as described in *British Journal of Photography Annual* 1979 pg 204. Red, green and blue densities of each exposed negative were then measured. A KODAK KDPC automatic printer algorithm was then used to calculate the printer saturation parameter of each negative exposed under each light source when the printer is set up on the film exposed under the simulated daylight. That is, the Example 1 film which photographed the gray target under the simulated daylight, was used as the standard negative (that is, D' was set to 0 for this negative) for the Example 1 film which photographed the gray target under the other lighting conditions. Similarly, the Example 2 film which photographed the gray film frame exposed under the simulated daylight illumination served as the standard negative for the Example 2 film which photographed the gray target under the other lighting conditions. A similar procedure was likewise followed for the films of Examples 3 through 6. To avoid contaminating the printer saturation results with the variability in gammas between the films of the EXAMPLES 1 to 6, the gammas of all films were corrected to 0.65 in the algorithm using the over/under setup parameters.

The film peak blue sensitivities are summarized below in Table 3 (two numbers indicate two peaks at the indicated wavelengths). Table 3 also all blue spectral sensitivity, $IS_{(400-500)}$. Note that shows the integrated spectral sensitivity between 425–450 nm, $IS_{(425-450)}$), as a percentage of the total of other than the comparative of Example 1, the foregoing percentage exceeds 25%. In each of the films of Examples 1 through 6, the maximum red sensitivity was at 652 nm and the maximum green sensitivity was at 548 nm. The values of the printer saturation for each negative under each lighting condition, are tabulated in Table 4 below. Average saturation values for each negative under all of the non-daylight lighting conditions, are provided in Table 4 under "Average" and also shown in Table 3. As pointed out above, the films exposed under simulated daylight were used as the standard negatives. Average values for each film exposed under the different lighting conditions are given on the line labeled "Average".

TABLE 3

| Film of Example | Blue Sensitivity | % of Total Integrated Spectral Sensitivity between 400–500 nm, which lies between 425–450 nm | Blue Sensitizing Dyes | Average Printer Saturation |
|---|---|---|---|---|
| 1 | 470 | 20.0 | YD-26 | 43 |
| 2 | 437 | 63.7 | YD-3 | 23 |
| 3 | 438,470 db | 37.4 | YD-26, YD-3 | 30 |
| 4 | 440 | 61.9 | YD-1 | 28 |
| 5 | 428 | 49.1 | YD-3a | 38 |
| 6 | 441,465 bd | 36.8 | YD-26, YD-1 | 33 |

db - double peaks, bd - broad peaks

TABLE 4

| Sample | Illuminant | Film of Example | Average Printer Saturation |
|---|---|---|---|
| 1 (C) | WWD | 1 | 64 |
| 2 (C) | U30 | 1 | 53 |
| 3 (C) | CW | 1 | 21 |
| 4 (C) | MV | 1 | 35 |
| | AVERAGE | 1 | 43 |
| 5 (I) | WWD | 6 | 51 |
| 6 (I) | U30 | 6 | 47 |
| 7 (I) | CW | 6 | 18 |
| 8 (I) | MV | 6 | 18 |
| | AVERAGE | 6 | 33 |
| 9 (I) | WWD | 3 | 45 |
| 10 (I) | U30 | 3 | 41 |
| 11 (I) | CW | 3 | 18 |
| 12 (I) | MV | 3 | 18 |
| | AVERAGE | 3 | 30 |
| 13 (I) | WWD | 4 | 41 |
| 14 (I) | U30 | 4 | 37 |
| 15 (I) | CW | 4 | 18 |
| 16 (I) | MV | 4 | 17 |
| | AVERAGE | 4 | 28 |
| 17 (I) | WWD | 2 | 28 |

TABLE 4-continued

| Sample | Illuminant | Film of Example | Average Printer Saturation |
|---|---|---|---|
| 18 (I) | U30 | 2 | 27 |
| 19 (I) | CW | 2 | 13 |
| 20 (I) | MV | 2 | 22 |
| | AVERAGE | 2 | 23 |
| 21 (I) | WWD | 5 | 55 |
| 22 (I) | U30 | 5 | 51 |
| 23 (I) | CW | 5 | 27 |
| 24 (I) | MV | 5 | 18 |
| | AVERAGE | 5 | 38 |

WWD = Philips Warm White Deluxe fluorescent bulb
U30 = Philips Ultralume 30 fluorescent bulb
CW = Philips Cool White fluorescent bulb
MV = Mercury Vapor lamp To illustrate elements of the present invention which were dyed to additionally provide substantial blue sensitivity in the 450–500 nm region, the following Examples 7 to 10 were prepared (Examples 7 and 9 are comparatives): EXAMPLES 7 and 8 share a common format as described below:

The following layers were coated onto a clear acetate film support in the order cited: The amounts are in mg per square meter (mg/m$^2$):

| | |
|---|---|
| Layer 1: Antihalation Layer | |
| grey silver | 150.0 |
| gelatin | 1614.6 |
| UV dye UV-1 | 75.3 |
| UV dye UV-2 | 32.3 |
| sequestrant and antistain agents as needed | |
| Layer 2: (Low Sensitivity Red-Sensitive Emulsion Layer) | |
| cyan emulsion CE-1 | 538.2 |
| cyan emulsion CE-2 | 430.4 |
| gelatin | 1460.1 |
| Coupler-1 | 478.8 |
| Coupler-2 | 64.6 |
| Coupler-3 | 5.4 |
| Layer 3: Middle Sensitivity Red-Sensitive Emulsion Layer | |
| cyan emulsion CE-3 | 968.8 |
| gelatin | 1345.0 |
| Coupler-3 | 43.04 |
| Coupler-1 | 355.1 |
| Coupler-2 | 21.5 |
| Coupler-4 | 10.7 |
| Layer 4: High Sensitivity Red-Sensitive Emulsion Layer | |
| cyan emulsion CE-4 | 861.1 |
| gelatin | 968.8 |
| Coupler-3 | 43.0 |
| Coupler-1 | 96.8 |
| Coupler-5 | 43.0 |
| Coupler-4 | 16.2 |
| Layer 5: Interlayer | |
| gelatin | 850.8 |
| oxidized developer scavenger ODS | 75.3 |
| antistain agent, surfactants, and antifoggants as needed. | |
| Layer 6: Low Sensitivity Green-Sensitive Emulsion Layer | |
| magenta emulsion ME-2 | 495.0 |
| gelatin | 1184.0 |
| Coupler-6 | 301.3 |
| Coupler-7 | 75.3 |
| Layer 7: Middle Sensitivity Green-Sensitive Emulsion Layer | |
| magenta emulsion ME-3 | 914.9 |
| gelatin | 1162.5 |

-continued

| | |
|---|---|
| Coupler-6 | 145.3 |
| Coupler-7 | 53.8 |
| Coupler-8 | 26.9 |
| Layer 8: High Sensitivity Green-Sensitive Emulsion Layer | |
| magenta emulsion ME-4 | 753.5 |
| gelatin | 968.4 |
| Coupler-6 | 64.6 |
| Coupler-9 | 10.8 |
| Coupler-7 | 43.0 |
| Layer 9: Yellow Filter Layer | |
| gelatin | 860.8 |
| oxidized developer scavenger ODS | 75.3 |
| yellow filter dye YFD | 166.8 |
| antistain agent, surfactants and antifoggant as needed. | |
| Layer 10: Low Sensitivity Blue-Sensitive Emulsion Layer | |
| yellow emulsion YE-1 | 161.5 |
| yellow emulsion YE-2 | 107.6 |
| yellow emulsion YE-3 | 269.1 |
| gelatin | 2280.1 |
| Coupler-5 | 699.7 |
| Coupler-10 | 592.0 |
| Coupler-11 | 118.4 |
| Coupler-2 | 5.4 |
| Coupler-8 | 21.5 |
| Layer 11: High Sensitivity Blue-Sensitive Emulsion Layer | |
| yellow emulsion YE-4 | 559.7 |
| gelatin | 753.5 |
| Coupler-5 | 178.7 |
| Coupler-10 | 151.8 |
| Coupler-11 | 57.0 |
| Coupler-2 | 1.4 |
| Coupler-8 | 5.4 |
| Layer 12: UV Absorbing Layer | |
| UV dye UV-1 | 107.6 |
| UV dye UV-2 | 107.3 |
| gelatin | 699.7 |
| Lippmann Silverbromide | 215.3 |
| Layer 13: Protective Overcoat Layer | |
| gelatin | 888.0 |
| surfactants, lubricant, antistatic agent, soluble matte agent. | |
| Hardener bis(vinylsulfonylmethyl) ether is also added. | |

This format shows a triple coated magenta record and a triple coated cyan record. The results can be demonstrated with double coated records. Alternatively, the layer order as presented in Eeles et al U.S. Pat. No. 4,184,876 with the Fast Cyan above a slower magenta layer would also work. It is important to achieve for this example, consistent linear D LogE curves, the couplers and levels can be varied. The magenta and cyan emulsions are also not critical, as long as they have the necessary curve shape (that is, so that all color records have consistent DlogE curves of the same gamma). Also, the cyan and magenta emulsions must show spectral sensitivity commonly observed in color films. For example, the maximum green spectral sensitivity should be in the range of 530–570 nm, the maximum red spectral sensitivity should be in the range of 590–670 nm. It is preferred that the magenta emulsions be tabular grain emulsions so that the red record acutance is less degraded than if conventional emulsions are used in the magenta record.

The material and amounts specified in Layers 10 and 11 will yield linear curve shape consistent with the density relationships of the magenta and cyan records to produce a balanced color film. Any other suitable means can be used to construct the red and green sensitive records.

EXAMPLE 8 was coated the same as EXAMPLE 7 with the following exceptions:

Emulsion YE-1 was replaced by Emulsion YE-1A.

Emulsion YE-2 was replaced by Emulsion YE-2A.

Emulsion YE-3 was replaced by Emulsion YE-3A.

Emulsion YE-4 was replaced by Emulsion YE-4A; the latter used at 699.4 mg/m$^2$.

The yellow emulsions in EXAMPLE 8 are exactly like those in EXAMPLE 7 except the spectral sensitizing dye used is YD-1 and YD-26 at a 1:1 molar ratio. Thus, the film elements of EXAMPLES 7 and 8 are the same except for their blue spectral sensitization.

A description of the emulsions used in the EXAMPLES 7 to 10 is shown in Table 5.

TABLE 5

| Emulsion | Iodide Content % | Grain Diameter ECD | Tab-ularity | Sensitizing Dyes | Dye Ratio |
|---|---|---|---|---|---|
| CE-1 | 1.3 | 0.54 | 77 | CD-1:CD-2 | 1 to 9 |
| CE-2 | 4.1 | 0.73 | 51 | CD-1:CD-2 | 1 to 9 |
| CE-3 | 4.1 | 0.93 | 73 | CD-1:CD-2 | 1 to 9 |
| CE-4 | 4.1 | 1.25 | 87 | CD-1:CD-2 | 1 to 9 |
| CE-4A | 4.1 | 1.25 | 87 | CD-3:CD-2 | 2 to 1 |
| CE-5 | 4.1 | 0.86 | 109 | CD-3:CD-2 | 2 to 1 |
| CE-6 | 4.1 | 2.6 | 149 | CD-3:CD-2 | 2 to 1 |
| ME-1 | 1.3 | 0.54 | 77 | MD-1:MD-2 | 1 to 3 |
| ME-2 | 2.6 | 0.75 | 57 | MD-1:MD-2 | 1 to 3 |
| ME-3 | 4.1 | 1.05 | 79 | MD-1:MD-2 | 1 to 3 |
| ME-4 | 4.1 | 1.25 | 87 | MD-1:MD-2 | 1 to 3 |
| ME-5 | 4.1 | 0.69 | 46 | MD-1:MD-2 | 1 to 3 |
| ME-6 | 4.1 | 1.06 | 120 | MD-1:MD-2 | 1 to 3 |
| ME-7 | 4.1 | 1.26 | 87 | MD-1:MD-2 | 1 to 3 |
| YE-1 | 1.3 | 0.54 | 77 | YD-26 | |
| YE-1A | 1.3 | 0.54 | 77 | YD-26:YD-1 | 1 to 1 |
| YE-2 | 1.5 | 1 | 59 | YD-26 | |
| YE-2A | 1.5 | 1 | 59 | YD-26:YD-1 | 1 to 1 |
| YE-3 | 4.1 | 1.3 | 77 | YD-26 | |
| YE-3A | 4.1 | 1.3 | 77 | YD-26:YD-1 | 1 to 1 |
| YE-4 | 4.1 | 2.6 | 149 | YD-26 | |
| YE-4A | 4.1 | 2.6 | 149 | YD-26:YD-1 | 1 to 1 |
| YE-1b | 2.7 | 1.38 | 625 | YD-26 | |
| YE-2b | 2.7 | 2.29 | 658 | YD-26 | |

The emulsion preparation procedure is well known, for example see U.S. Pat. No. 4,439,520 or U.S. Pat. No. 5,272,048. For emulsions CE-1, ME-1, ME-2, YE-1, YE-1A, YE-2 and YE-2A, the iodide is added at 70% of the precipitation. Emulsions YE-1b and YE-2b have the iodide added during the interval of 17 to 95% of the precipitation. The remainder of the emulsions in the EXAMPLES 7 to 10 are run dump iodide of which 1.1% is added through 70% of the precipitation and 3% is added at the 70% point. All the emulsions follow a typical sulfur and gold chemical sensitization and a spectral sensitization with the respective sensitizing dyes.

CD-1 is Anhydro-9-ethyl-5,5'-dimethyl-3,3'-bis(3-sulfopropyl)thiacarbocyanine hydroxide, triethylamine salt.

CD-2 is Anhydro-5,5'-dichloro-9-ethyl-3,3'bis(3-sulfopyrpyl)thiacarbocyanine hydroxide, ion salt.

CD-3 is Anhydro-9-ethyl-3-methyl-5'-phenyl-3'-(4sulfobutyl)thiacarbocyanine hydroxide.

MD-1 is Anhydro-6,6'-dichloro-1,1'-diethyl-3,3'bis(3-sulfopropyl)-5,5'-ditrifluoromethylbenzimidazolocarbocyanine hydroxide, sodium salt.

MD-2 is Anhydro-5-chloro-9-ethyl-5'-phenyl-3'-(3-sulfobutyl)-3-(3-sulfopropyl)oxacarbocyanine hydroxide, sodium salt.

Other film components are as follows:

UV-1 is 3-(Di-n-hexylamino)allylidene malononitrile.

UV-2 is 2-Propenoic acid, 2-cyano-3-( 4methoxyphenyl)-, propyl ester.

YFD is 1-Butanesulfonamide, N-(4-(4-cyano-2-(2furanylmethylene)-2,5-dihydro-5-oxo-3-furanyl) phenyl)-.

Coupler-1 is Hexanamide,2-(2,4-bis(1,1-dimethylpropyl)phenoxy)-N-(4-((((4-cyanophenyl)amino)carbonyl)amino)-3-hydroxyphenyl)-.

Coupler 2 is Propanoic acid, 3-((3-(((4-(2,4 bis (1,1dimethylpropyl)phenoxy)butyl)amino)carbonyl)-4-hydroxy 1-naphthalenyl) thio)-.

Coupler 3 is 2-Naphthalenecarboxamide, 1-hydroxy-4-(4(((1-((4-methoxyphenyl)methyl)-1H-tetrazol-5-yl)thio)methyl)-2-nitrophenoxy)-N-(2-(tetradecyloxy)phenyl)-.

Coupler 4 is 2,7-Naphthalenedisulfonic acid, 5-(acetylamino)-3-((4-((3-(((4-(2,4-bis (1,1-dimethylpropyl)phenoxyl)butyl)amino)carbonyl)-4-hydroxy-1-naphthalenyl)oxy)phenyl)azo)-4-hydroxy -, disodium salt.

Coupler-5 is Benzoic acid, 4-chloro-3-((2-(4-ethoxy-2,5-dioxo-3-(phenyl)methyl)-1-imidazolidinyl)-4,4-dimethyl-1,3-dioxopentyl)amino-,dodecyl.

Coupler 6 is Tetradecanamide, N-(3-((4-((2-((2-(2,4-bis-(1,1-dimethylpropyl)phenoxy)-1oxobutyl)amino)phenyl)thio)-4,5-dihydro-1-(2,4,6-trichlorophenyl)-1H-pyrazol-3-yl)amino)-4-chlorophenyl)-.

Coupler-7 is Tetradecanamide, N-(4-chloro-3-((4-((3,4-dimethoxyphenyl)azo)-4,5-dihydro-5-oxo-1-(2,4,6-trichlorophenyl)-1H-pyrazol-3-yl)amino)phenyl)-2-(3(1,1-dimethylethyl)-4-hydroxyphenoxy)-.

Coupler 8 is 2-Naphthalenecarboxamide, 1-hydroxy-4-(2-nitro-4-(((1-phenyl-1H-tetrazol-5-yl)thio)methyl)phenoxy)-N-(2-(tetradecyloxy)phenyl)-.

Coupler-9 is Butanamide,2-(2,4-bis(1,1-dimethylpropyl)phenoxy)-N-(4-(4,5-dihydro-5-oxo-4-((1-phenyl-1H-tetrazol-5-yl)thio)-3-(1-pyrolidinyl)-1H-pyrazol-1-yl)phenyl)-.

Coupler-10 is Benzoic acid, 4-chloro-3-((2-(4-ethoxy2,5-dioxo-3-(phenylmethyl)-1-imidazolidinyl)-3-(4-methoxyphenyl)-1,3-dioxopropyl)amino)-, dodecyl ester.

Coupler-11 is 1H-Tetrazole-1-acetic acid, 5-(((((2-(1-(((2-chloro- 5-((hexadecylsulfonyl)amino)phenyl)amino)carbonyl)-3,3-dimethyl-2-oxobutoxy)-5-nitrophenyl)methyl)ethylamino)carbonyl)thio)-,propyl ester.

Coupler 12 is Naphthalenecarboxamide, 4-((1-ethyl)-1H-tetrazol-5-yl)thio)-1-hydroxy-N-(2-tetradecyloxy)phenyl)-.

Coupler 13 is 1H-tetrazole-1-acetic acid, 5-(((4-((3-(aminocarbonyl)-4-hydroxy-1-naphthalenyl)oxy)-3-((hexadecylsulfonyl))amino)phenyl)methyl)thio)-, propyl ester.

Coupler 14 is Propanoic acid, 3-(((2-dodecyloxy-5-methylphenyl)amino)carbonyl)-4-hydroxy-1naphthalenyl) thio).

ODS is 1,4-Benezenediol,2,5-bis(1,1,3,3-tetramethylbutyl)-.

The following layers were coated over a clear acetate film support in the order cited. As in EXAMPLES 7 and 2, the amounts are in mg per square meter.

EXAMPLE 9(Comparative)

| | |
|---|---|
| Layer 1: Antihalation Layer | |
| grey silver | 150.0 |
| UV dye UV-1 | 75.3 |
| gelatin | 2,421.0 |
| sequestrants and antistain agents as needed | |
| Layer 2: Low Sensitivity Red-Sensitive Emulsion Layer | |
| Cyan Emulsion CE-1 | 527.2 |
| Cyan Emulsion CE-5 | 527.2 |
| Coupler-2 | 53.8 |
| Coupler-1 | 538.0 |
| gelatin | 1,775.4 |
| Layer 3: Middle Sensitivity Red-Sensitive Emulsion Layer | |

-continued

| | |
|---|---|
| Cyan Emulsion CE-4A | 807.0 |
| Coupler-2 | 32.3 |
| Coupler-1 | 258.2 |
| Coupler-3 | 59.2 |
| Coupler-4 | 43.0 |
| gelatin | 1,614.0 |
| Layer 4: High Sensitivity Red-Sensitive Emulsion Layer | |
| Cyan Emulsion CE-6 | 860.8 |
| Coupler-1 | 96.8 |
| Coupler-3 | 45.2 |
| Coupler-4 | 43.0 |
| Coupler-12 | 5.4 |
| gelatin | 1,718.4 |
| Layer 5: Interlayer | |
| ODS-1 | 75.3 |
| gelatin | 860.8 |
| Layer 6: Low Sensitivity Green-Sensitive Emulsion Layer | |
| Magenta Emulsion ME-1 | 258.3 |
| Magenta Emulsion ME-5 | 516.5 |
| Coupler-6 | 247.5 |
| Coupler-7 | 32.3 |
| gelatin | 1,667.8 |
| Layer 7: Middle Sensitivity Green-Sensitive Emulsion Layer | |
| Magenta Emulsion ME-6 | 1,022.2 |
| Coupler-6 | 129.1 |
| Coupler-7 | 64.6 |
| Coupler-9 | 2.7 |
| Coupler-13 | 10.8 |
| gelatin | 1,571.0 |
| Layer 8: High Sensitivity Green-Sensitive Emulsion Layer | |
| Magenta Emulsion ME-7 | 1,129.8 |
| Coupler-6 | 96.8 |
| Coupler-7 | 53.8 |
| Coupler-9 | 2.2 |
| Coupler-13 | 37.7 |
| gelatin | 1,398.8 |
| Layer 9: Yellow Filter Layer | |
| YFD | 134.5 |
| ODS | 107.6 |
| gelatin | 860.8 |
| Layer 10: Low Sensitivity Blue-Sensitive Emulsion Layer | |
| Yellow Emulsion YE-1b | 484.2 |
| Coupler-5 | 742.9 |
| Coupler-10 | 161.4 |
| Coupler-11 | 32.3 |
| Coupler-14 | 5.4 |
| gelatin | 1,775.4 |
| Layer 11: High Sensitivity Blue-Sensitive Emulsion Layer | |
| Yellow Emulsion YE-2b | 376.6 |
| Coupler-5 | 236.7 |
| Coupler-10 | 139.9 |
| Coupler-11 | 64.6 |
| Coupler-14 | 5.4 |
| gelatin | 1,076.0 |
| Layer 12: Protective Overcoat | |
| Lippmann Silver Bromide | 107.6 |
| UV dye UV-1 | 107.6 |
| UV dye UV-2 | 107.6 |
| gelatin | 1,076.0 |
| Hardener Bis(vinylsulfonylmethy) ether was added. | |

Figure 7:
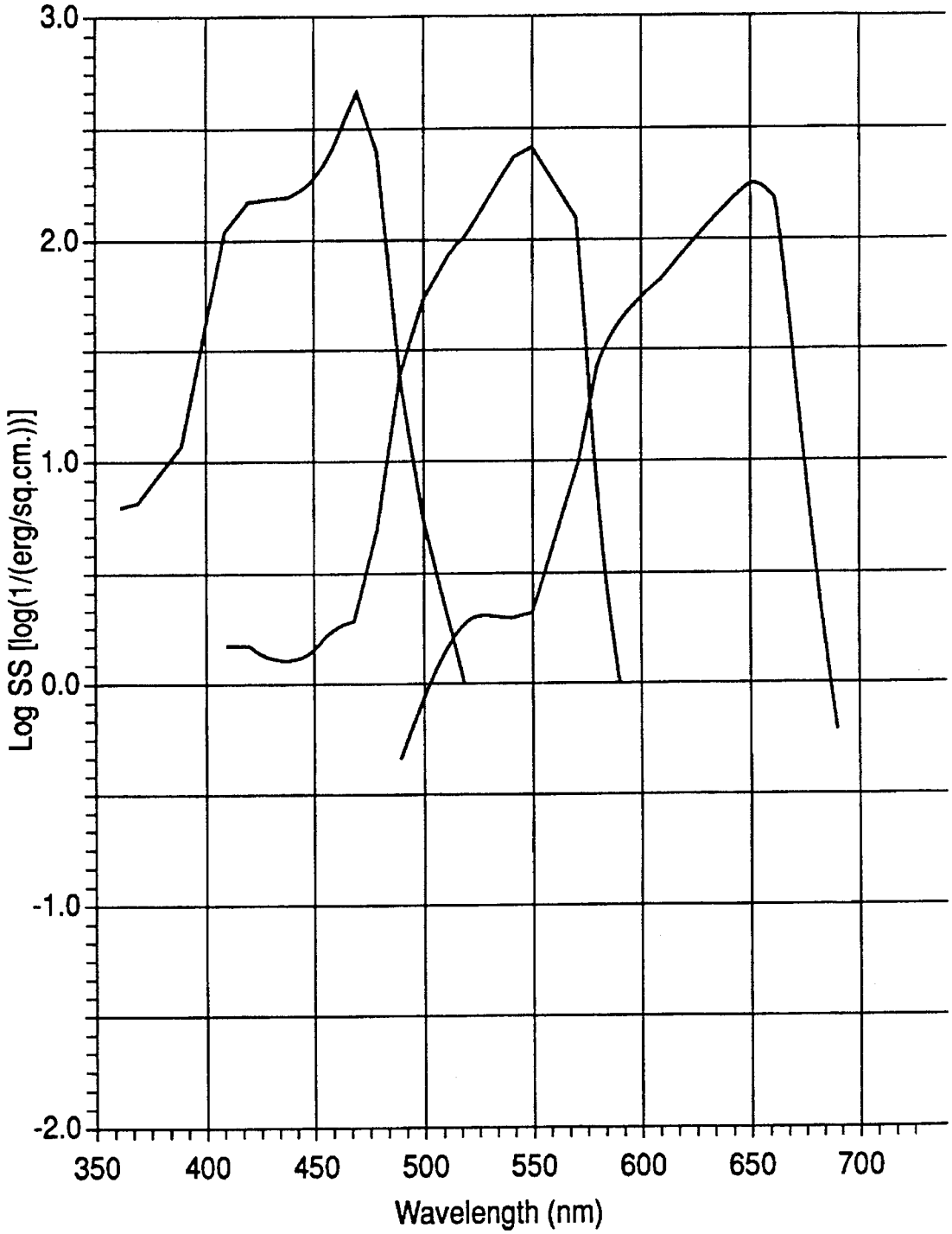
FIGS. 7 and 8 show the sensitivity profile of the blue sensitive layers of the films of Examples 7 and 8, respectively.
Figure 8:
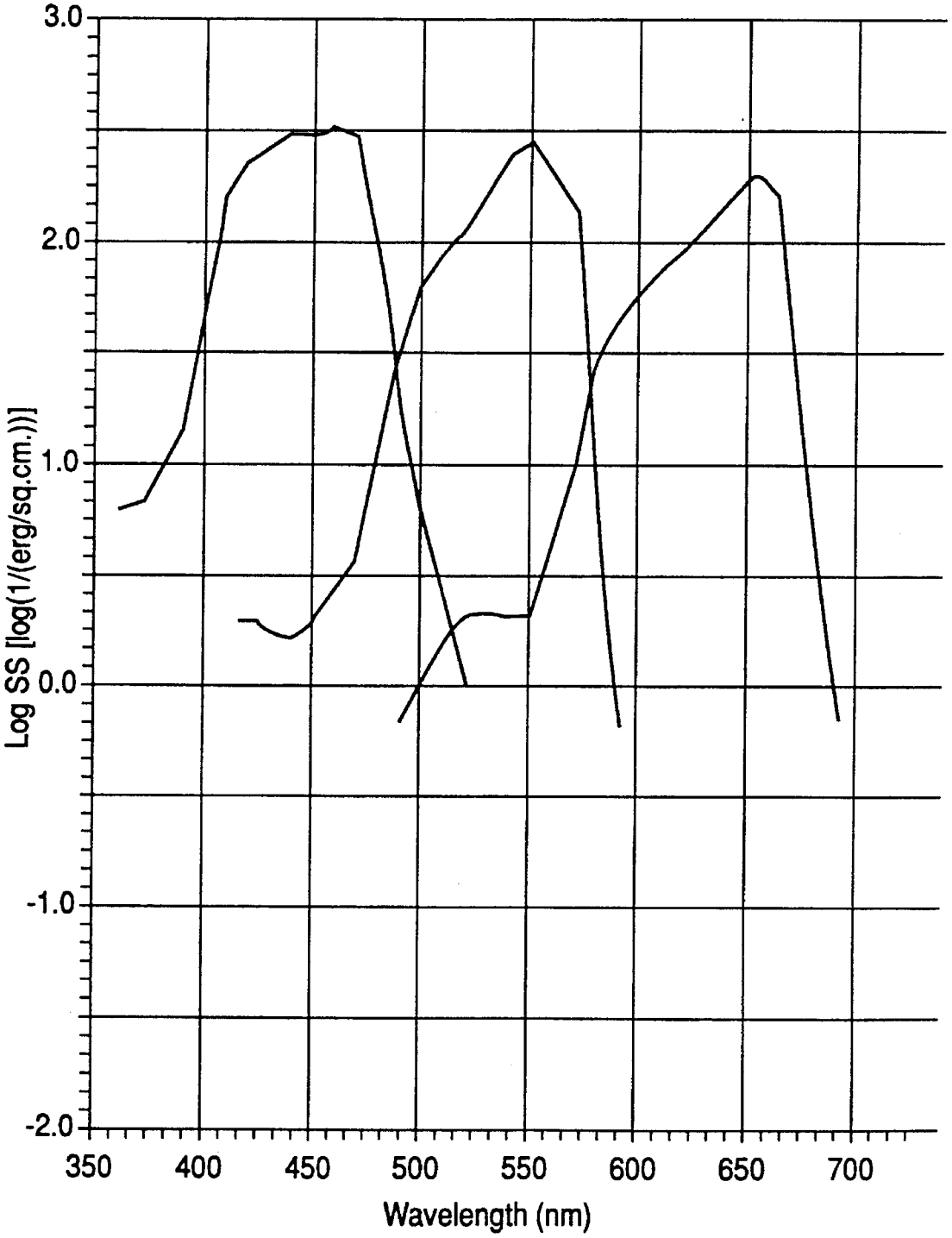

EXAMPLE 10 (Invention) is identical to EXAMPLE 9 with the following exceptions:

Layer 10: Low Sensitivity Blue-Sensitive Emulsion Layer Yellow emulsion YE-3b was used in place of YE-1b Layer 11: High Sensitivity Blue-Sensitive Emulsion Layer Yellow Emulsion YE-4b was used in place of YE-2b It is very important that the examples show the same linear curveshape for all three records because the overall color reproduction is also dependent on careful balance of the three records. After verifying that each film had the same gamma values for corresponding color records (for example: the red gamma of one film is the same as the red gamma of the other film; the green gamma of one film is the same as the green gamma of the other film), the spectral sensitivity of each film was measured. FIG. 7 shows the spectral sensitivity of the film element of EXAMPLE 7. Note that the EXAMPLE 7 film element has a narrow blue spectral sensitivity profile with a peak wavelength at 470 nm. FIG. 8 shows the spectral sensitivity of the film element of EXAMPLE 8. Note that the Example 8 film has a broader blue sensitivity profile than the negative of EXAMPLE 7. In particular, the Example 8 film (invention) has a peak sensitivity at 440 nm and another peak at 460 nm. The height of the two peaks are about equal. The sensitivity at 485 nm is less than 50% of the maximum sensitivity and the sensitivity at 410 nm is less than 60% of either the peak at 440 nm or 460 nm.

Each of several light sources was used to photograph a gray target with the two films which differ only in the shape of the blue spectral sensitivity. The light sources included Warm White Deluxe fluorescent, Cool White fluorescent, Ultralume(economy fluorescent), Mercury Vapor lights and a simulated daylight ("HMI"). The films were processed in standard C-41 chemistry as described in British Journal of Photography Annual 1979 pg 204. A Kodak KDPS automatic printer was then used to measure the printer saturation parameter of each negative exposed under each light source when the printer is set up on the film exposed under the simulated daylight. That is, the Example 7 film which photographed the gray target under the simulated daylight, was used as the standard negative (that is, D' was set to 0 for this negative) for the Example 7 film which photographed the gray target under the other lighting conditions. Similarly, the Example 8 film which photographed the gray film frame exposed under the simulated daylight illumination served as the standard negative for the Example 8 film which photographed the gray target under the other lighting conditions.

The exposed negatives were then printed in an automatic printer with two different settings of the printer correction algorithm (50% or 100% chromatic correction) to illustrate the advantages in final print color balance when negatives of the present invention are printed versus other negatives. For the film of each of Example 7 to 10, the procedure consisted of (1) setting up the printer using as a standard negative, the negative from the film of the same example used to photograph the gray card under the an HMI simulated daylight so that the printer produced a perfect gray print on KODAK Edge photographic paper, and (2) using the automatic printer mechanism to print the exposed negatives made under the illuminants described using either (A) 50% chromatic correction or (B) 100% chromatic correction and the subject failure suppression (SFS) boundary described in Goll et al. reference, above. Procedure A is typical of a modern minilab operation while procedure B is typical of modern high volume photofinishing operation. The T-space boundary (described above) used in the examples below where procedure (B) was used (hue dependent color correction), was defined by the following points in T-space:

| Hue | Saturation | Hue |
|---|---|---|
| 9 | 100 | 12 |
| 21 | 35 | 31 |
| 39 | 500 | 42 |
| 69 | 55 | 71 |
| 100 | 35 | 114 |

The status A densities of the resulting prints were measured, and trilinear plotting analysis was used to determine the magnitude and direction of the residual color print balance. The values of the printer saturation and residual print balance are tabulated below. The film peak sensitivities are summarized below in Table 6 (two numbers indicate two peaks at the indicated wavelengths).

1976 CIELab color space calculations recommended in CIE Publication 15.2. Such calculations are also described in *Measuring Colour* R. W. G. Hunt, 1987 (published by Ellis Horwood Limited, Chichester, West Sussex, England).

TABLE A

| Film from Example | Wavelength of Maximum Blue Sensitivity | Wavelength of Maximum Green Sensitivity | Wavelength of Maximum Red Sensitivity |
|---|---|---|---|
| EXAMPLE 7 (C) | 470 nm | 547 nm | 655 nm |
| EXAMPLE 8 (I) | 440 nm and 461 | 547 nm | 655 nm |
| EXAMPLE 9 (C) | 472 nm | 549 | 630 |
| EXAMPLE 10 (I) | 438 nm and 470 nm | 549 | 630 |

(I) = invention;
(C) = comparative

TABLE B

| Sample | Illuminant | Film of Example | Average Printer Saturation | 50% Correction Residual Print Balance CIELAB | Hue Dependent Correction Residual Print Balance CIELAB |
|---|---|---|---|---|---|
| 1 (C) | WWD | 7 | 51 | 36 | 59 |
| 2 (C) | U30 | 7 | 41 | 29 | 54 |
| 3 (C) | CW | 7 | 17 | 18 | 18 |
| 4 (C) | MV | 7 | 22 | 21 | 27 |
| | AVERAGE | 7 | 33 | 26 | 40 |
| 5 (I) | WWD | 8 | 44 | 31 | 38 |
| 6 (I) | U30 | 8 | 36 | 25 | 46 |
| 7 (I) | CW | 8 | 15 | 17 | 15 |
| 8 (I) | MV | 8 | 14 | 17 | 14 |
| | Average | 8 | 27 | 23 | 28 |
| 9 (C) | WWD | 9 | 54 | 38 | 65 |
| 10 (C) | U30 | 9 | 48 | 33 | 59 |
| 11 (C) | CW | 9 | 20 | 16 | 20 |
| 12 (C) | MV | 9 | 33 | 24 | 43 |
| | Average | 9 | 39 | 28 | 47 |
| 13 (I) | WWD | 10 | 41 | 31 | 39 |
| 14 (I) | U30 | 10 | 41 | 31 | 47 |
| 15 (I) | CW | 10 | 15 | 17 | 15 |
| 16 (I) | MV | 10 | 9 | 12 | 7 |
| | Average | 10 | 27 | 23 | 27 |

WWD = Philips Warm White Deluxe fluorescent bulb
U30 = Philips Ultralume 30 fluorescent bulb
CW = Philips Cool White fluorescent bulb
MV = Mercury Vapor lamp The films of Examples 8 and 10 are inventive films, while those of Examples 7 and 9 are comparatives. The films of Examples 7 and 8 have matched red, green and blue gamma values. The films of Example 9 and 10 also have matched red, green and blue gamma values, but the gamma values of Example 9 and 10 films are higher than those of the films of Examples 7 and 8. The values for each light source are provided in Table 7 below.

The print color balance and printer saturation for each film exposed under each light source, and printed with either 50% correction or hue dependent correction (as described above) are listed below in Table 7. As pointed out above, the films exposed under simulated daylight were used as the standard negatives. Average values for each film exposed under the different lighting conditions are given on the line labeled "Average". CIELab values were obtained using the Reviewing the results from Table 7, it will be seen that each inventive film, when exposed under any of the described lights and processed in the automatic printer, provided a lower printer saturation value than a film not meeting the requirements of the present invention. Further, regardless of the type of printer correction, lower saturation values, as expected, lead to lower residual print color balance. Also, the type of printer correction algorithm used did not change this result. For example, this can be seen by comparing samples 1 and 5, or 11 and 15, or any other combination of inventive and non-inventive films exposed under the same lighting conditions, regardless of the printer correction used.

While the invention has been described in detail with particular reference to preferred embodiments, it will be understood that variations and modifications can be effected within the spirit and scope of the invention.

We claim:

1. A color photographic negative element comprising a transparent base and a blue sensitive silver halide emulsion layer which satisfies each of the following spectral sensitivity requirements:

$$S_{max(426-444\ nm)} \geqq 65\% S_{max(400-500\ nm)}$$

$$IS_{(425-450)} \geqq 25\% (IS_{(400-500)})$$

in which $S_{max(426-444\ nm)}$ is the maximum sensitivity between 426 to 444 nm, $S_{max(400-500\ nm)}$ is the maximum sensitivity between 400–500 nm, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm, said element having associated therewith an indication for processing by a color negative process.

2. A color photographic negative element comprising a transparent base and a blue sensitive silver halide emulsion layer which satisfies each of the following spectral sensitivity requirements:

$$426\ \text{nm} \geqq \lambda_{Bmax} \geqq 444\ \text{nm}$$

$$S_{\{400-(\lambda Bmax-15),(\lambda Bmax+15)-500\}} \geqq 65\% (S_{\lambda Bmax})$$

$$IS_{(400-450)} \geqq 25\% (IS_{(400-500)})$$

in which $\lambda_{Bmax}$ is the wavelength of maximum blue sensitivity of the blue sensitive layer, $S_{\lambda Bmax}$ is the sensitivity at $\lambda_{Bmax}$, $S_{\{400-(\lambda Bmax-15),(\lambda Bmax+15)-500\}}$ is the sensitivity anywhere within the region 400 to 500 nm except the region within ±15 nm of $\lambda_{Bmax}$, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm, said element having associated therewith an indication for processing by a color negative process.

3. A color photographic negative element comprising a transparent base and a red sensitive silver halide emulsion layer containing a coupler which produces a cyan dye upon reaction with oxidized developer, a green sensitive silver halide emulsion layer containing a coupler which produces a magenta dye upon reaction with oxidized developer, and a blue sensitive silver halide emulsion layer containing a coupler which produces a yellow dye upon reaction with oxidized developer, wherein the blue sensitive silver halide emulsion layer satisfies each of the following spectral sensitivity requirements:

$$S_{max(426-444)} \geqq 65\% (S_{\lambda Bmax})$$

$$IS_{(425-450)} \geqq 25\% (IS_{(400-500)})$$

in which $S_{max(426-444\ nm)}$ is the maximum sensitivity between 426 to 444 nm, $S_{max(400-500\ nm)}$ is the maximum sensitivity between 400–500 nm, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm, said element having associated therewith an indication for processing by a color negative process.

4. A color photographic negative element comprising a transparent base and a blue sensitive silver halide emulsion layer which satisfies each of the following spectral sensitivity requirements:

$$S_{max(426-444\ nm)} \geqq 65\% S_{max(400-500\ nm)}$$

$$IS_{(425-450)} \geqq 25\% (IS_{(400-500)})$$

in which $S_{max(426-444\ nm)}$ is the maximum sensitivity between 426 to 444 nm, $S_{max(400-500\ nm)}$ is the maximum sensitivity between 400–500 nm, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm; the element containing a masking coupler or a preformed dye which is not removed during processing, said element having associated therewith an indication for processing by a color negative process.

5. A color photographic negative element comprising a transparent base and a blue sensitive silver halide emulsion layer which satisfies each of the following spectral sensitivity requirements:

$$426\ \text{nm} \leqq \lambda_{Bmax} \leqq 444\ \text{nm}$$

$$S_{\{400-(\lambda Bmax-15),(\lambda Bmax+15)-500\}} < 65\% (S_{\lambda Bmax})$$

$$IS_{(425-450)} \geqq 25\% (IS_{(400-500)})$$

in which $\lambda_{Bmax}$ is the wavelength of maximum blue sensitivity of the blue sensitive layer, $S_{\lambda Bmax}$ is the sensitivity at $\lambda_{Bmax}$, $S_{\{400-(\lambda Bmax-15),(\lambda Bmax+15)-500\}}$ is the sensitivity anywhere within the region 400 to 500 nm except the region within ±15 nm of $\lambda_{Bmax}$, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm; the element containing a masking coupler or a preformed dye which is not removed during processing, said element having associated therewith an indication for processing by a color negative process.

6. A color photographic negative element comprising a transparent base and a red sensitive silver halide emulsion layer containing a coupler which produces a cyan dye upon reaction with oxidized developer, a green sensitive silver halide emulsion layer containing a coupler which produces a magenta dye upon reaction with oxidized developer, and a blue sensitive silver halide emulsion layer containing a coupler which produces a yellow dye upon reaction with oxidized developer, wherein the blue sensitive silver halide emulsion layer satisfies each of the following spectral sensitivity requirements:

$$S_{max(426-444)} \geqq 65\% (S_{\lambda Bmax})$$

$$IS_{(425-450)} \geqq 25\% (IS_{(400-500)})$$

in which $S_{max(426-444\ nm)}$ is the maximum sensitivity between 426 to 444 nm, $S_{max(400-500\ nm)}$ is the maximum sensitivity between 400–500 nm, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm; wherein the element contains a masking coupler, said element having associated therewith an indication for processing by a color negative process.

7. A color photographic element according to claim 6 wherein:

$$426\ \text{nm} \leqq \lambda_{Bmax} \leqq 444\ \text{nm}$$

$$S_{\{400-(\lambda Bmax-15),(\lambda Bmax+15)-500\}}<65\%(S_{\lambda Bmax})$$

$$IS_{(425-450)}\geqq 25\%(IS_{(400-500)})$$

in which $\lambda_{Bmax}$ is the wavelength of maximum blue sensitivity of the blue sensitive layer, $S_{\lambda Bmax}$ is the sensitivity at $\lambda_{Bmax}$, $S_{\{400-(\lambda Bmax-15),(\lambda Bmax+15)-500)\}}$ is the sensitivity anywhere within the region 400 to 500 nm except the region within ±15 nm of $\lambda_{Bmax}$, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm.

8. A color photographic element according to claim 6 wherein:

$$615\text{ nm}\leqq\lambda_{Rmax}\leqq 640\text{ nm}$$

wherein λRmax is the wavelength of maximum red sensitivity of the red sensitive layer.

9. A color photographic element according to claim 6 wherein the silver halide emulsion of the blue sensitive layer is a silver halide tabular grain emulsion the halide content of which is less than 80% chloride and the grains of which have a tabularity of at least 8.

10. A color photographic element according to claim 9 wherein the silver halide emulsion of the blue sensitive layer is a silver halide tabular grain emulsion the halide content of which is less than 80% chloride and the grains of which have a tabularity of at least 100.

11. A color photographic element according to claim 9 wherein the silver halide emulsion of the blue sensitive layer is a silver bromoiodide tabular grain emulsion having a tabularity of at least 100.

12. A color photographic element according to claim 6 wherein silver halide emulsion of the blue sensitive layer has a halide content which is less than 10% chloride and less than 10% silver iodide.

13. A color photographic element according to claim 9 wherein the tabular grain emulsion of the blue sensitive layer is sensitized by at least one cyanine dye.

14. A color photographic negative element according to claim 1 wherein the silver halide emulsion of the blue sensitive layer is a tabular grain emulsion sensitized with a dye which on the emulsion, provides a peak sensitivity between 426–444 nm, and sensitized with another dye which on the emulsion, provides a peak sensitivity between 450–500 nm.

15. A method of processing a photographic negative element having a transparent base and a blue sensitive silver halide emulsion layer which satisfies each of the following spectral sensitivity requirements:

$$S_{max(426-444\ nm)}\geqq 65\%S_{max(400-500\ nm)}$$

$$IS_{(425-450)}\geqq 25\%(IS_{(400-500)})$$

in which $S_{max(426-444\ nm)}$ is the maximum sensitivity between 426 to 444 nm, $S_{max(400-500\ nm)}$ is the maximum sensitivity between 400–500 nm, $IS_{(425-450)}$ is the integrated spectral sensitivity of the blue sensitive layer from 425 to 450 nm, and $IS_{(425-450)}$ is the integrated spectral sensitivity of the blue sensitive layer in the region 400–500 nm;

the method comprising exposing the element to a developing agent to form a negative dye image.

16. A method of processing a photographic element according to claim 3, comprising exposing the element to a developing agent to form a negative dye image.

17. A method of processing a photographic negative according to claim 4, comprising exposing the element to a developing agent to form a negative dye image.

* * * * *

UNITED STATES PATENT AND TRADEMARK OFFICE

CERTIFICATE OF CORRECTION

PATENT NO. : 5,576,157
DATED : November 19, 1996
INVENTOR(S) : Jon N. Eikenberry et al.

It is certified that error appears in the above-identified patent and that said Letters Patent is hereby corrected as shown below:

Column 29, claim 1,
Line 18, delete "$IS_{(425\ 450)}$" and insert -- $IS_{(400\text{-}500)}$ --

Column 29, claim 2,
Lne 31, delete "$IS_{(400\ 500)}$" and insert -- $IS_{(425\text{-}450)}$ --

Column 29, claim 2,
Line 38, delete "$IS_{(425\ 450)}$" and insert -- $IS_{(400\text{-}500)}$ --

Column 29, claim 3,
Line 62, delete "$IS_{(425\ 450)}$" and insert -- $IS_{(400\text{-}500)}$ --

Column 30, claim 4,
Line 11, delete "$IS_{(425\ 450)}$" and insert -- $IS_{(400\text{-}500)}$ --

Column 30, claim 5,
Line 33, delete "$IS_{(425\ 450)}$" and insert -- $IS_{(400\text{-}500)}$ --

Column 30, claim 6,
Line 59, delete "$IS_{(425\ 450)}$" and insert -- $IS_{(400\text{-}500)}$ --

Column 31, claim 7,
Line 10, delete "$IS_{(425\ 450)}$" and insert -- $IS_{(400\text{-}500)}$ --

Column 32, claim 15,
Line 25, delete "$IS_{(425\ 450)}$" and insert -- $IS_{(400\text{-}500)}$ --

Signed and Sealed this

Eighteenth Day of December, 2001

*Attest:*

*Attesting Officer*

JAMES E. ROGAN
*Director of the United States Patent and Trademark Office*